US009798285B1

(12) United States Patent
Guerand

(10) Patent No.: US 9,798,285 B1
(45) Date of Patent: Oct. 24, 2017

(54) DOOR-ACTUATED FEED ROLL SEPARATOR MECHANISM FOR AN IMAGING DEVICE

(71) Applicant: LEXMARK INTERNATIONAL, INC., Lexington, KY (US)

(72) Inventor: Daniel Guerand, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/245,324

(22) Filed: Aug. 24, 2016

Related U.S. Application Data

(60) Provisional application No. 62/331,578, filed on May 4, 2016.

(51) Int. Cl.
*G03G 21/16* (2006.01)

(52) U.S. Cl.
CPC ..... *G03G 21/1633* (2013.01)

(58) Field of Classification Search
None
See application file for complete search history.

(56) References Cited

U.S. PATENT DOCUMENTS

2005/0040583 A1* 2/2005 Murakami ..... G03G 15/232 271/65
2006/0104665 A1* 5/2006 Koshida ..... G03G 21/1638 399/124
2007/0031165 A1* 2/2007 Lee ..... G03G 21/1638 399/124
2007/0228646 A1* 10/2007 Sekiyama ..... B42C 1/12 271/264

* cited by examiner

*Primary Examiner* — Thomas Giampaolo, II
(74) *Attorney, Agent, or Firm* — John Victor Pezdek

(57) ABSTRACT

An imaging device having a door-actuated feed roll separator mechanism. A pair of opposed panels of a frame of the imaging device are positioned parallel to a media path. A feed roll pair in the media path has a drive roll fixedly and rotatably mounted between the panels and a backup roll translateably mounted between the panels. A pair of cam followers are rotatably mounted to the backup roll. The backup roll is biased against the drive roll forming a feed nip. A door pivotally mounted along a bottom end to the frame substantially covers the media path. A pair of door-mounted, spring-biased actuators engage with the pair of cam followers. With the door lowered, the cam followers rotate with a camming surface thereon contacting the drive roll, translating the backup roll away from the drive roll and opening the feed nip to allow for removal of jammed media.

20 Claims, 16 Drawing Sheets

DOOR-ACTUATED FEED ROLL SEPARATOR MECHANISM FOR AN IMAGING DEVICE

CROSS REFERENCES TO RELATED APPLICATIONS

The present application is related to and claims priority under 35 U.S.C. 119(e) from U.S. provisional application No. 62/331,578, filed May 4, 2016, entitled, "Door-Actuated Media Feed Nip Release Mechanism," the content of which is hereby incorporated by reference herein in its entirety. This application is also related to U.S. patent application Ser. No. 15/142,158 entitled "Door-Actuated Feed Roll Separator For An Imaging Device," filed Apr. 29, 2016, and assigned to the assignee of the present disclosure.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media feed systems for an imaging device, and, in particular, to devices for separating feed roll pairs to assist with media jam removal.

Description of the Related Art

Imaging devices such as electrophotographic printers employ a plurality of pairs of parallel rollers to feed and move media. The rollers may be constructed of rubber, rubber coated metal, metal, plastic or combinations of these materials. In each pair, one of the rollers, usually the drive roller, has a fixed position in the frame of the device while the mating roller, usually termed an idler roll or a backup roll, generally has a spring or spring device applying defined amount of force to it to press the two rolls together in an interference type position as opposed to the two rolls being tangential. The drive and backup rolls form between them a linear area of rotary friction which is generally known as a "feed nip" or "nip" into which a media sheet is fed and that is used to move the media sheet along a media path in a controlled manner.

During operation, the media sheet sometimes becomes jammed within the media path and must be removed by the user. The difficulty of the media removal process depends on the accessibility of the jam area and the degree to which the media has become trapped within the media transport system. In prior art designs, the user was required to either pull the media sheet through the feed nip overcoming the forces of the drive mechanism and springs or attempt to remove the trapped media by exploring through the available openings, sometimes resulting in the media sheet being torn and only partially removed. Some imaging device embodiments contain a user activated mechanism for separating drive and backup rolls and freeing the jammed media sheet for easier removal. Successful use of this manual release mechanism depends on the user knowing it is there, knowing how to activate it and finally remembering to release the mechanism to close the feed nip in order for printing to continue. Another drawback with some prior art feed nip release mechanisms is that should the release mechanism break, operation of the feed roll pair may be hampered or prevented due to the malfunction of the release mechanism.

It would be advantageous for a user to automatically be able to open the feed nip to clear a media jam and then automatically close the feed nip without the use of a manually operated separator mechanism. It would be further advantageous to allow for automatic opening of the feed nip without the need for additional motors, door tethers or complicated release features. It would be still further advantageous that the separators be operable to reopen the nip should they be accidentally returned to their closed position without the need to manually reposition them.

SUMMARY OF THE INVENTION

Disclosed is an imaging device having a door-actuated separator mechanism for a feed roll pair. The imaging device comprises a frame having a pair of opposed panels with the pair of opposed panels having a first and a second pair of opposed openings. The pair of opposed panels is positioned parallel to a media path and has mounted thereto a feed roll pair for transporting a media sheet along the media path. A door is pivotally mounted along a bottom edge thereof to the frame. The door has a raised closed position and a lowered open position. The door has a pair of opposed spring-biased actuators provided on an inner surface thereof adjacent to a respective left and a respective right edge of the door. The door substantially covers the media path between the pair of opposed panels when in the closed position. The feed roll pair has a drive roll and a backup roll forming a feed nip therebetween. The ends of the drive roll are rotatably and fixedly mounted in a pair of opposed bushings mounted in the first pair of opposed openings. The ends of the backup roll extend through opposed bushings in the second pair of opposed openings and are rotatable and translatable within the second pair of opposed openings. The backup roll is translateably mounted to the pair of opposed panels and spring-biased into contact with the drive roll. The drive roll has a shaft having a radius RE The backup roll has a shaft having a radius R2. The distance between the respective surfaces of the shafts of the backup roll and the drive roll is a predetermined distance D1.

The imaging device further includes a separator mechanism for separating the backup roll from the drive roll. The separator mechanism includes a spring-biased first actuator arm and a first cam follower. The spring-biased first actuator arm is pivotally mounted on the inner surface of the door extending therefrom toward the feed roll pair. The first actuator arm has a free end with a cylindrical pin depending therefrom. The first cam follower is rotatably mounted on the shaft of the backup roll. The first cam follower comprises a plate having: a top, a bottom, a first side surface and a second side surface; a mounting slot having a closed circular end positioned approximately in the center of the plate and sized to rotatably receive the shaft of the backup roll and having an open end extending through the second side surface and the bottom; an engagement slot having a first wall and a second wall angled to form a generally V-shaped opening with an open end positioned in the top of the plate with the first and second walls having a first and a second catch point, respectively. The plate further includes the first side surface having a first camming surface along a portion thereof with the first camming surface positioned at a distance D2 from the surface of the shaft of the backup roll that is greater than the distance D1. The second side surface and a portion of the top adjacent to the second side surface of the cam follower form an inverted L-shaped second camming surface.

When the door is in the closed position, the pin is biased into the engagement slot and the first cam follower is in a disengaged position with respect to the shaft of the drive roll, the feed nip is closed and a spacing between respective centers of the shafts of the backup roll and the drive roll is substantially equal to R1+R2+D1. As the door is opened, the pin engages with the second catch point rotating the first cam follower in a first direction so that the first camming surface contacts the shaft of the drive roll translating the backup roll away from the drive roll to open the feed nip and the spacing between respective centers of the shafts of the backup roll and the drive roll is substantially equal to R1+R2+D2. As the door continues to open, the pin disengages from the second catch point and exits the engagement slot with the first cam follower in an engaged position with the shaft of the drive roll. When the door is moved back from the open position to the closed position, the pin is biased into contact with the second camming surface and rides thereon and reenters the engagement slot and engages with the first catch point. As the door continues closing, the first actuator arm rotates the first cam follower in a second direction opposite to the first direction to disengage the first camming surface of the first cam follower from the shaft of the drive roll allowing the backup roll to translate back toward the drive roll closing the feed nip.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 15A shows the access door in the closed position, the separator mechanism in its disengaged position with the actuator arm in its initial position within the engagement channel of the cam follower and the feed roll pair in their normal media feeding position with the feed nip closed; FIG. 15B shows the initial engagement of the actuator arm with the cam follower as the access door begins to open; FIG. 15C shows continued opening of the access door with the actuator arm rotating the cam follower on the backup roll causing the cam follower to initially engage with the drive roll to begin the separation of the backup roll from the drive roll; FIG. 15D shows further opening of the access door with the cam follower reaching its fully engaged position with the drive roll and opening the feed nip; FIG. 15E shows the disengagement of the actuator arm from the cam follower as the access door is moved to its open position; FIG. 15F shows the access door closing with the actuator arm initially contacting the cam follower; and FIG. 15G shows the actuator arm in the engagement channel of the cam follower prior to rotating the cam follower back it to its disengaged position shown in FIG. 15A.

FIG. 16A shows the separator mechanism accidentally returned to its disengaged position; FIG. 16B shows the initial contact of the actuator arm with the cam follower; FIGS. 16C-16D show the travel of the actuator arm on the cam follower as the door continues to close with the feed roll pair in their normal media feeding position; FIG. 16E shows the actuator arm entering the engagement channel of the cam follower; and FIG. 16F shows the actuator arm in its initial position within the engagement channel and the access door in the closed position.

DETAILED DESCRIPTION

Figure 1:
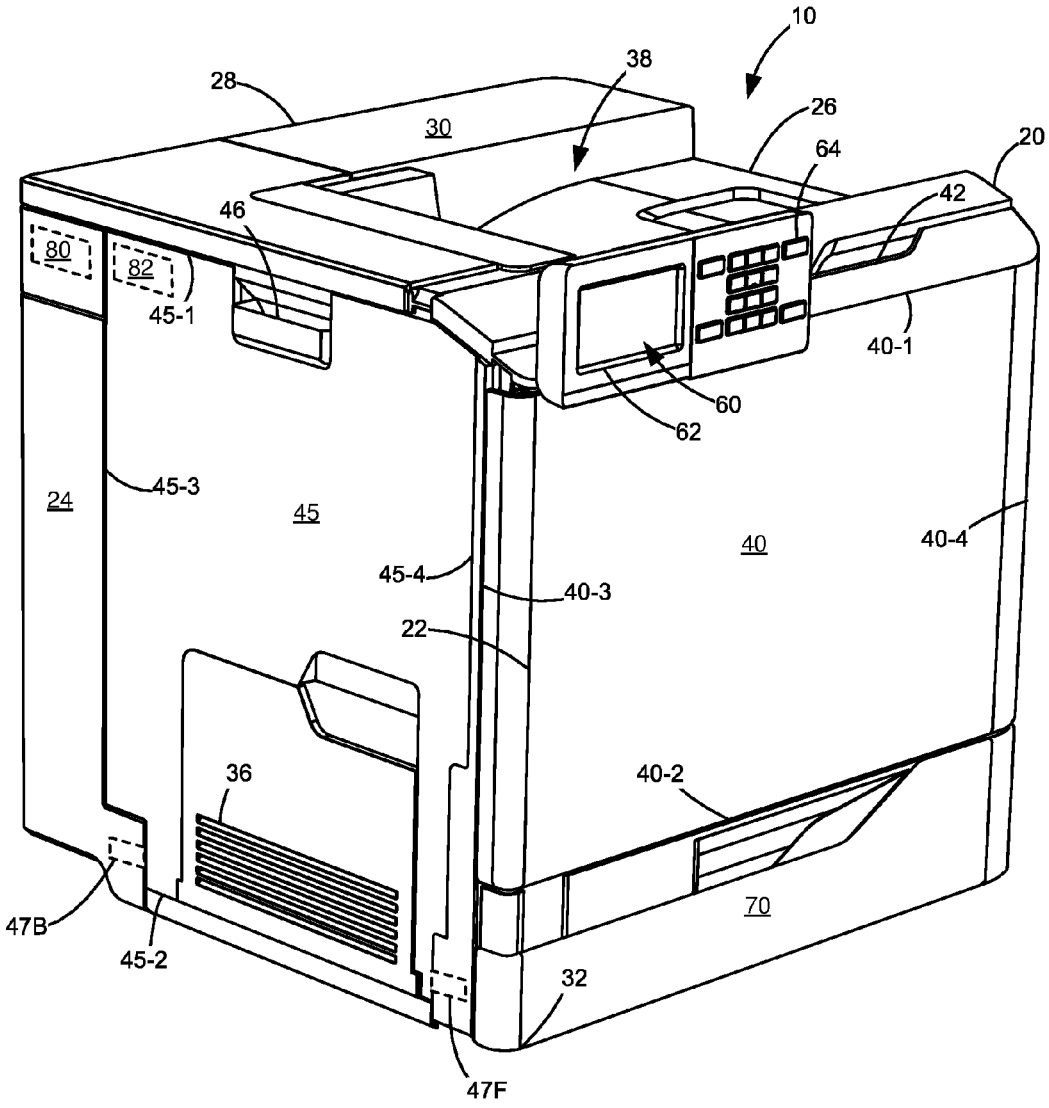
FIG. 1 is a perspective view of an imaging device having a side access door using a door-actuated feed roll separator mechanism of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to be example embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and generally means from an input toward an output of the imaging device.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet or IEEE 802.xx.

FIG. 1 illustrates an example imaging device 10 having a housing 20 having a front 22, first and second sides 24, 26, a rear 28, a top 30 and a bottom 32. Ventilation openings, such as vents 36 on first side 24 are provided. A media output area 38 is provided in top 30 for printed media exiting imaging device 10. A door 40 is provided on the front 22 of imaging device 10. Door 40 has a top edge 40-1, a bottom edge 40-2, a left edge 40-3, and a right edge 40-4. Door release 42 is provided near top edge 40-1 and is used to open door 40 to allow user access into the interior of imaging device 10 for replenishing supply items such as toner cartridges. Side access door 45 is provided in first side 24 and has a top edge 45-1, a bottom edge 45-2, a back edge 45-3, and a front edge 45-4. Side access door 45 covers portions of the media path and various feed roll pairs provided in imaging device 10. As shown, side access door 45 is pivotally mounted on front and back pivot posts 47F, 47B provided adjacent to its bottom edge 45-2. Door release 46 is provided near top edge 45-1 and is used to open side access door 45 when clearing a media jam from the media path within imaging device 10. Side access door 45 is shown in a raised closed position. A removable media tray 70 for providing media to be printed is slidably inserted into imaging device 10 below door 40.

A user interface 60, comprising a display 62 and a key panel 64, may be located on the front 22 of housing 20. Using the user interface 60, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A controller 80 is mounted within imaging device 10 and is used to control operation of imaging device 10, including a drive motor 84 (see FIG. 3) used to rotate one or more feed roll pairs to convey media through imaging device 10, motors for a pick mechanism for feeding media sheets from the removable media tray 70, and imaging operations, such as printing. Controller 80 is in operable communication with user interface 60.

Controller 80 includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller. Controller 80 may be illustrated in the figures as a single entity but it is understood that controller 80 may be implemented as any number of controllers, microcontrollers and/or processors.

Figure 2:
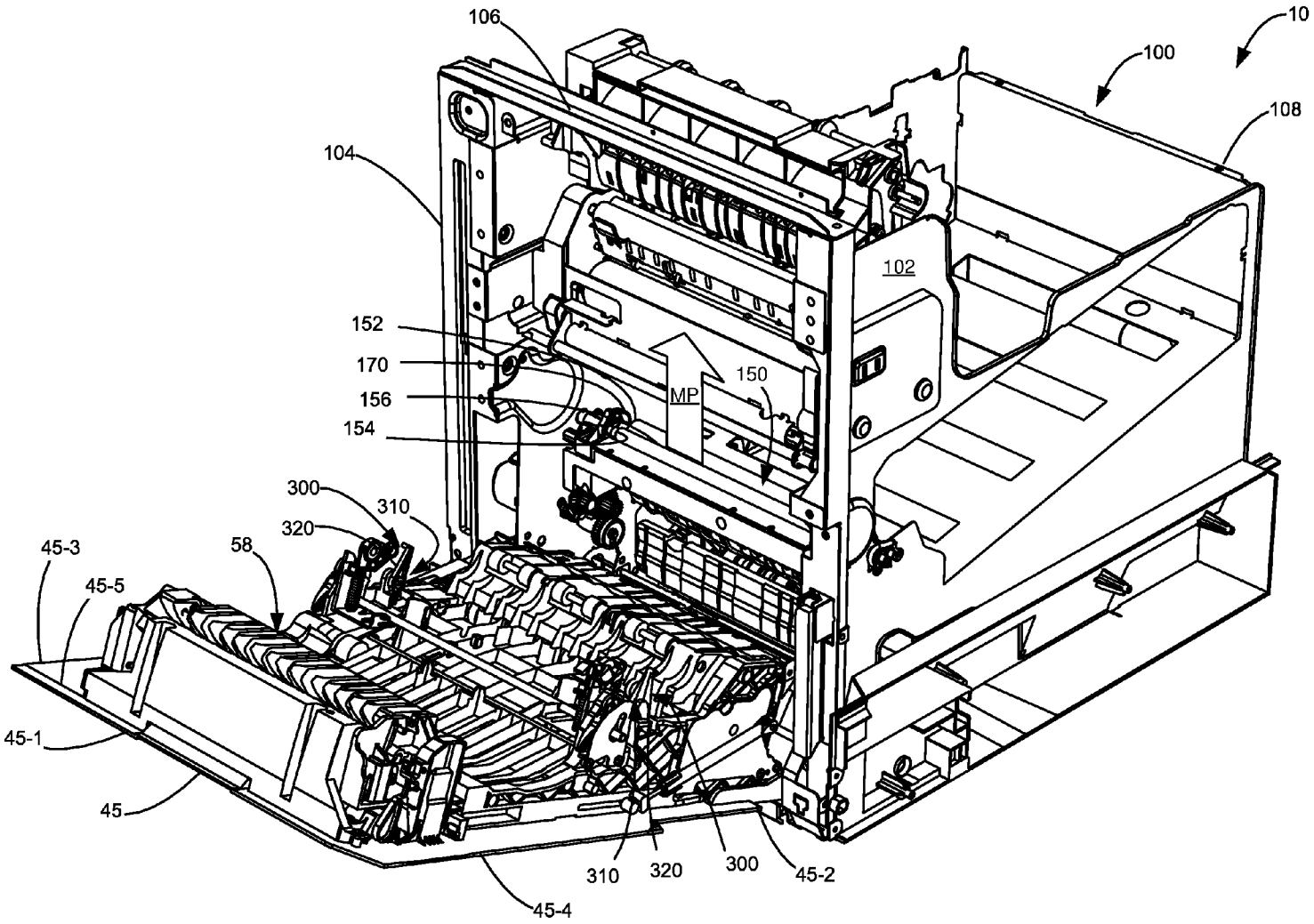
FIG. 2 is a perspective illustration of the imaging device of FIG. 1 having the separator mechanism of the present disclosure showing an interior frame of the imaging device and the left side access door in an open position.

FIG. 2 illustrates imaging device 10 with its front and back covers removed to show a feed roll pair 150 mounted to frame 100 along with having separator mechanisms 300 of the present disclosure mounted in part to side access door 45. Frame 100 includes a front panel 102 and a back panel 104 interconnected by opposed side panels, shown as left and right side panels 106, 108. A media path MP, indicated by the arrow MP, is present between front and back panels 102, 104. Mounted in media path MP is at least one feed roll pair 150 that is mounted to front and rear panels 102, 104 as described hereinafter. Feed roll pair 150 consists of a drive roll 152 and a backup roll 154 that form feed nip 156 therebetween. Drive roll 152 has a drive gear 170 mounted thereon that is driven by drive motor 84 and gear train 86 also schematically shown in FIG. 3. Drive roll 152 is rotatably and fixedly mounted to front and back panels 102, 104, while backup roll 154 is rotatably and translateably mounted to the front and back panels 102, 104 using two substantially similar front and back translation assemblies 172F, 172B described in more detail with reference to FIGS. 3-6. Media is fed through feed nip 156 along media path MP upwardly as shown. A plurality of parallel ribs 58 are provided on an inner surface 45-5 of access door 45 and serve as media guides along a duplex portion of the media path MP when door 45 is raised in the closed position. Actuator arms 320 of separator mechanisms 300 can be seen mounted on inner surface 45-5 near back and front edges 45-3, 45-4. With side access door 45 raised into a closed position, actuator arms 320 are aligned with feed roll pair 150.

Figure 3:
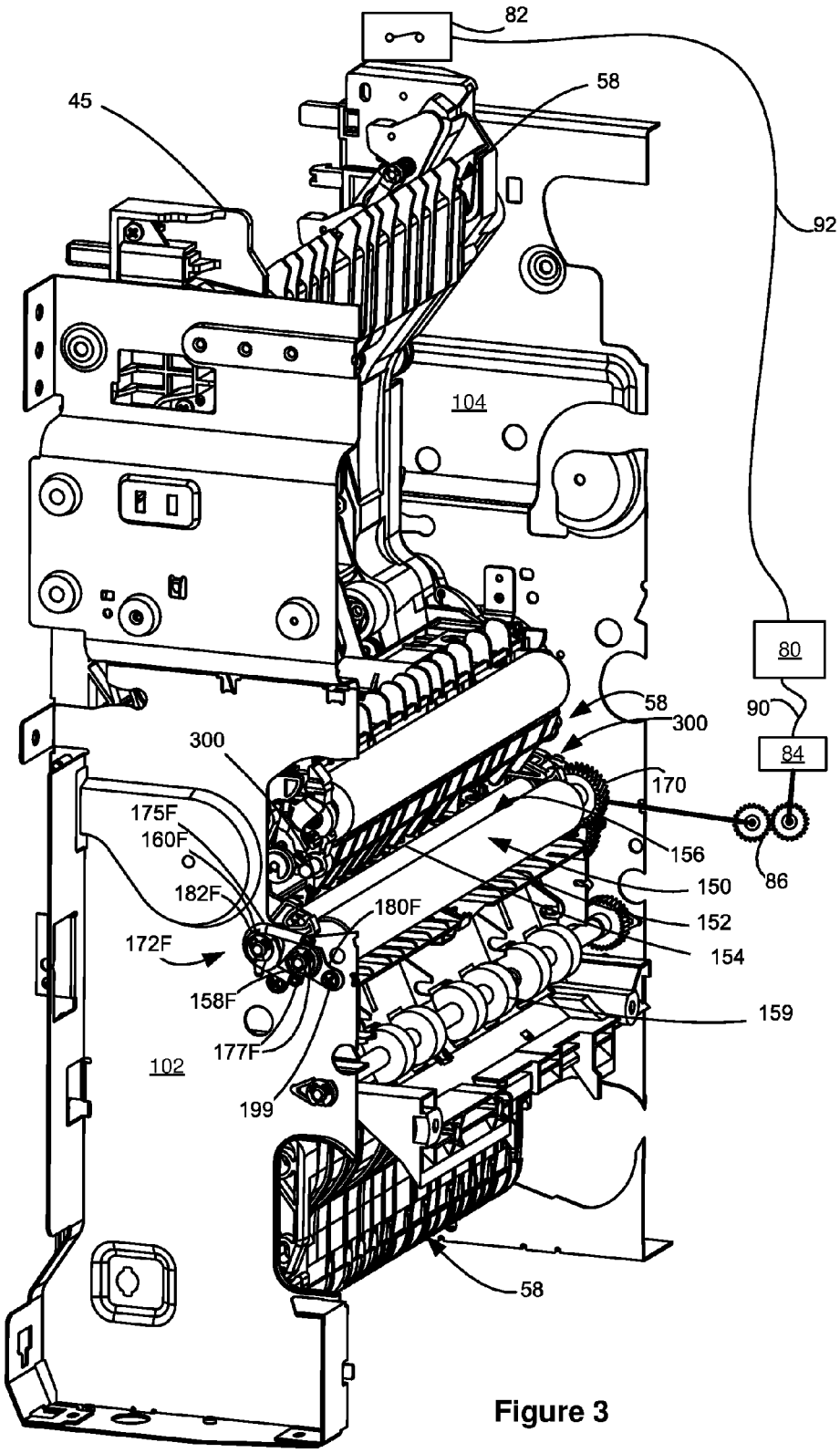
FIGS. 3-4 are the front and rear side perspectives of the front and back panels of the frame, respectively, showing a feed roll assembly and front and back separator mechanisms of the present disclosure.
Figure 4:
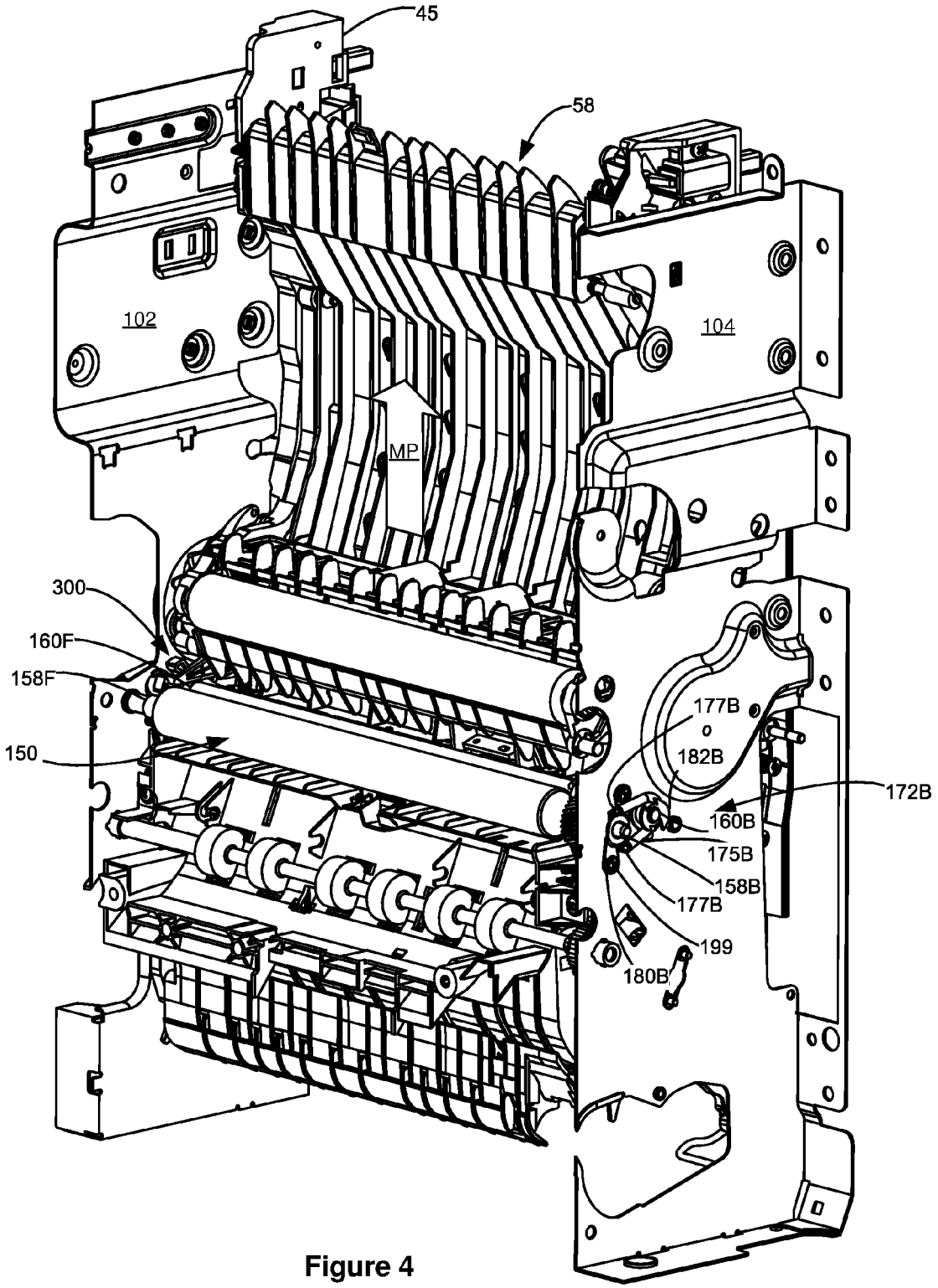
Figure 5:
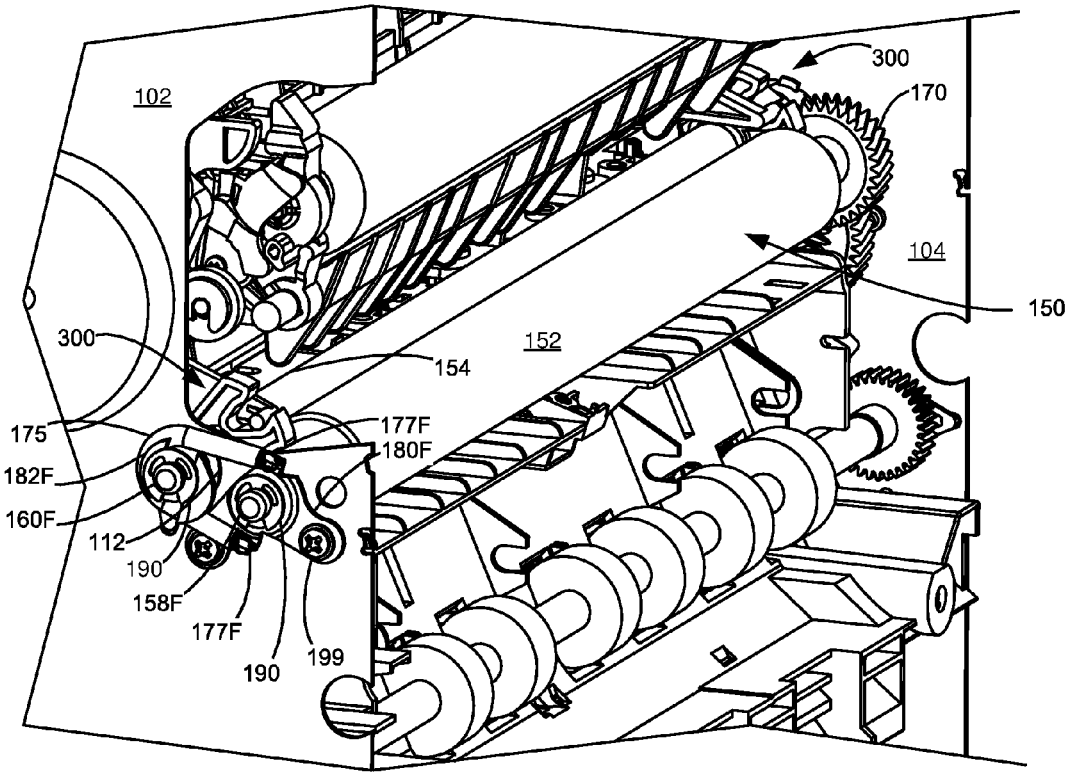
FIGS. 5-6 are enlarged partial perspective views of the spring-biased mounting of the feed roll assembly also showing the front and back of the separator mechanisms of the present disclosure.
Figure 6:
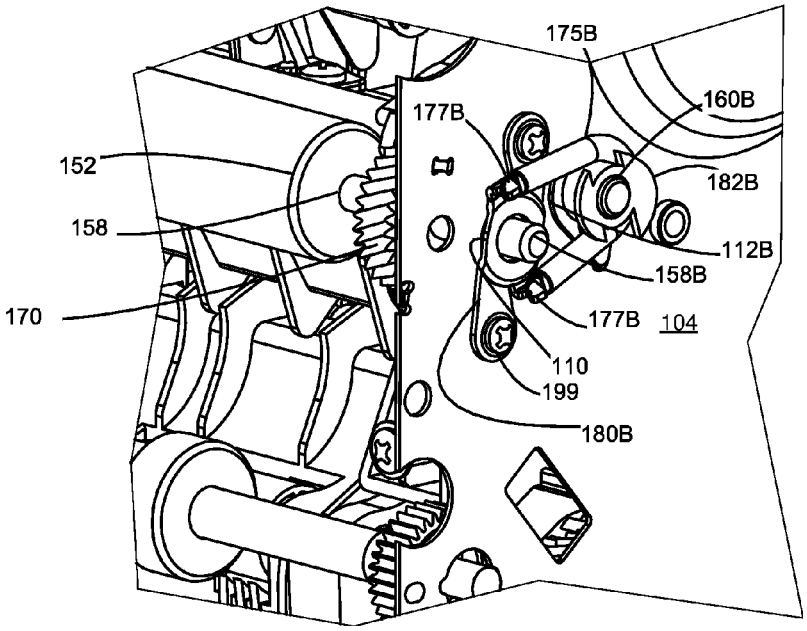

Controller 80 is used to control rotation of feed roll pair 150. As shown in FIG. 3, drive motor 84 is coupled to drive gear 170 on drive roll 152 via gear train 86. Drive motor 84 may be unidirectional or reversible. Drive motor 84 is in operative communication with controller 80 via communication link 90. Various sensors, such as a door interlock sensor 82 are also in operative communication with controller 80 via a communication link 92. When side access door 45 is in the raised or closed position, interlock sensor 82 is actuated and controller 80 will permit operation of drive motor 84 to rotate drive roll 152, allowing a media sheet to be fed along the media path MP shown in FIG. 2. When side access door 45 is in the lowered or open position, interlock sensor 82 is deactuated and controller 80 will prevent operation of drive motor 84 allowing a media sheet that may be jammed in feed roll pair 150 to be removed.

Referring to FIGS. 3-8, the mounting of feed roll pair 150 to front and rear panels 102, 104 is shown along with the mounting of two separator mechanisms 300. A first and a second pair of opposed openings 110, 112 are provided in front and rear panels 102, 104. First pair of opposed openings 110 are circular while second pair of opposed openings 112 are rounded end slots (See FIG. 9). Front and back drive roll bushings 180F, 180B are mounted in the first pair of opposed openings 110 and are secured to front and back panels 102, 104 by fasteners 199. The front and back ends 158F, 158B of shaft 158 of drive roll 152 are received in front and back drive roll bushings 180F, 180B, respectively. Front and back backup roll bushings 182F, 182B are mounted in the second pair of opposed opening 112 and are translateably mounted to front and back panels 102, 104 by a tab 186 and an inner flange 185 (see FIG. 9) that are positioned about the inner and outer surfaces of the two panels. The front and back ends 160F, 160B of shaft 160 of backup roll 154 are received in front and back backup roll bushings 182F, 182B, respectively. An outer flange 184 is also provided on each of the backup roll bushings 182F, 182B outboard of inner flange 185 and with inner flange 185 form a channel that receives a bias spring. As shown, front and back bias springs 175F, 175B are wrapped around a portion of front and back backup roll bushings 182F, 182B and have their respective ends attached to front and back spring mount pairs 177F, 177B that are provided on the front and back panels 102, 104 above and below the front and back ends 158F, 158B of shaft 158. Bias springs 175F, 175B and backup roll bushings 182F, 182B form translatable spring mounts for backup roll 154. Backup roll 154 is free to translate with respect to drive roll 152. Both rolls 152, 154 are vertically located in frame 100 by the two pairs of opposed openings 110F, 110B and 112F, 112B (see FIGS. 5-6) provided in front and back panels 102, 104, respectively. Bias springs 175F, 175B provide a biasing force to backup roll 154 to direct it into contact with drive roll 152 closing feed nip 156 and each bias spring provides a biasing force in the range of 5±0.5 pounds, for example. The spring forces may be the same or different depending on the design of the feed roll pair and may be lesser or greater than the example range stated. Bias springs 175F, 175B are designed to provide the biasing force needed to handle the range of media types that may be fed along media path MP in imaging device 10.

Figure 9:
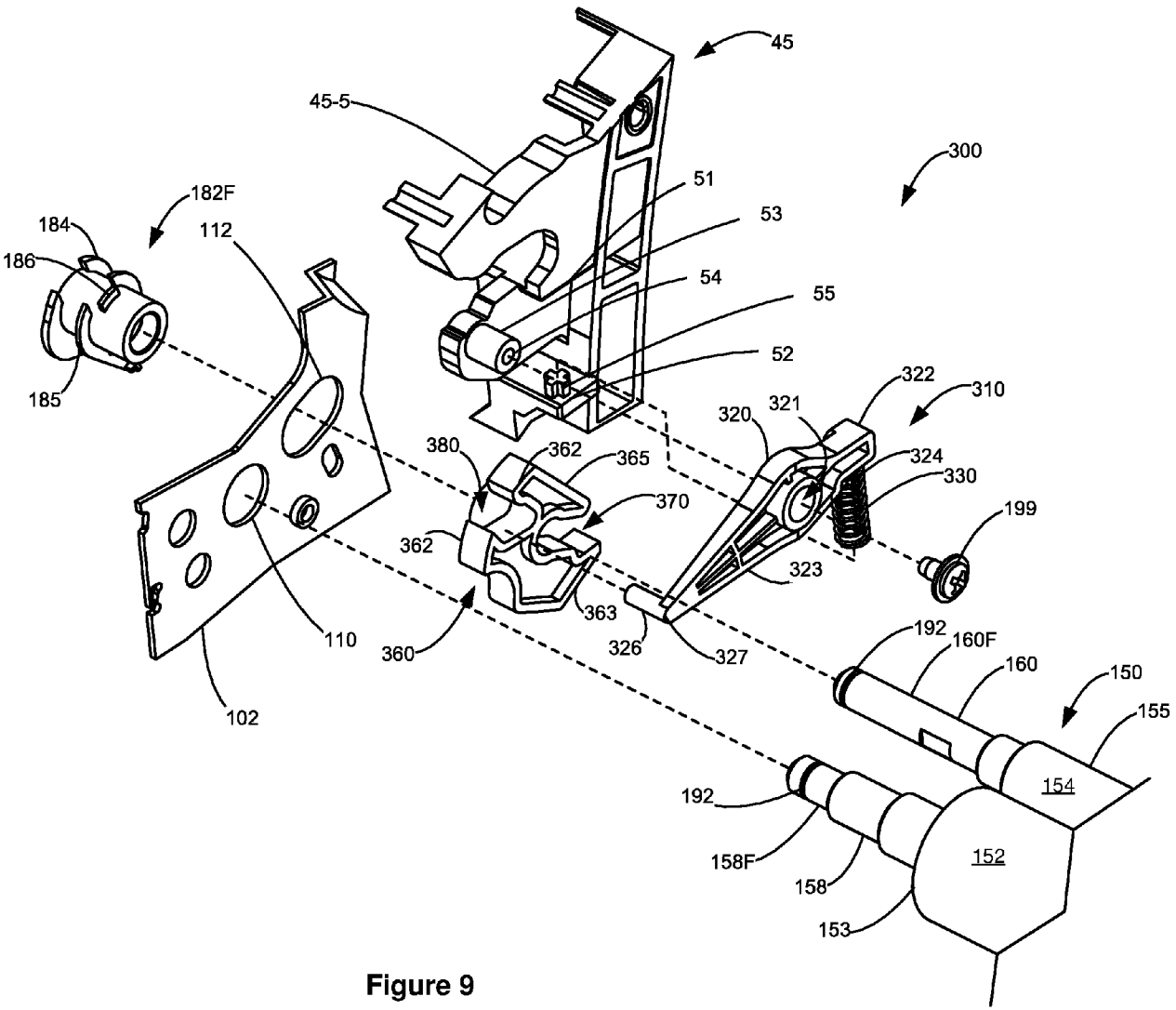
FIG. 9 is an exploded view of the front feed roll separator mechanism of the present disclosure.
Figure 10:
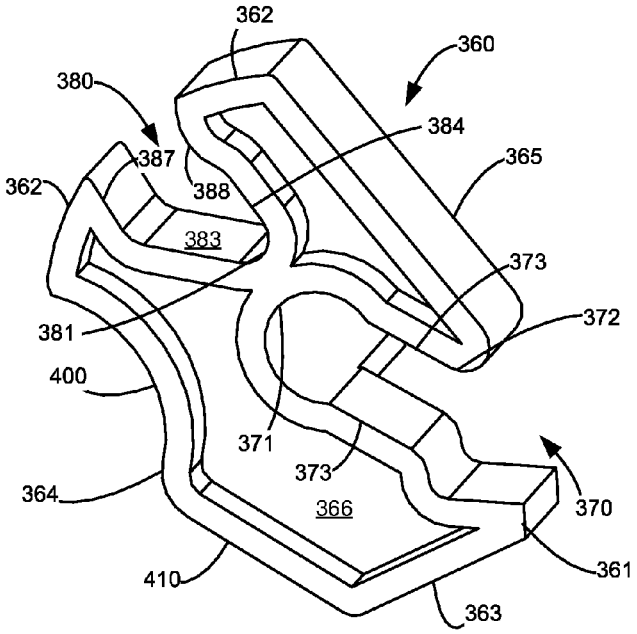
FIGS. 10-12 illustrate a cam follower used in the separator mechanism of the present disclosure.

Referring to FIG. 9, as shown drive roll 152 of feed roll pair 150 has a shaft 158 having an expanded covering 153 of a compliant material (such as rubber as a non-limiting example) or, as known, may have a plurality of rollers spaced along the shaft 158 as shown by roll 159 in FIG. 3. Covering 153 has a diameter that is greater than that of shaft 158. Drive gear 170 is secured to shaft 158 by known means such as the use of flats or by use of an interference fit between drive gear 170 and shaft 158. Front and back bushings 180F, 180B rotatably support drive roll 152. Backup roll 154 of feed roll pair 150 as shown, is a solid steel roll having at least one expanded cylindrical portion 155 having a diameter that is larger than that of shaft 160. Backup roll 154 may also be constructed similarly to drive roll 152 and have a compliant covering or compliant rollers. Feed nip 156 is formed between the two rolls 152, 154. E-clips 190 mount in grooves 192 outboard of front bushings 180F, 182F when drive roll 152 and backup roll 154 are mounted (see FIG. 5). Inner flange 185 and tab 186 on bushings 182F, 182B, respectively, have a diameter that is greater than that of opposed openings 112F, 112B so that when E-clips 190 are mounted, drive roll 152 and backup roll 154 are fixed between front and back panels 102, 104. The construction of drive roll 152 and backup roll 154 is a matter of design choice and not of limitation.

As shown in FIG. 3, two substantially identical separator mechanisms 300 are provided and each consists of an actuator assembly 310 mounted on an interior surface 45-5 of access door 45 and a cam follower 360 mounted on backup roll 154. Details of separator assemblies 300 may be found in the description of FIGS. 7-14 and their operation is described with respect to FIGS. 15A-16F. Because the two separator mechanisms 300 are substantially identical, like elements will have like reference numbers. Separator mechanism 300 comprises actuator assembly 310 and roll-mounted cam follower 360.

Figure 7:
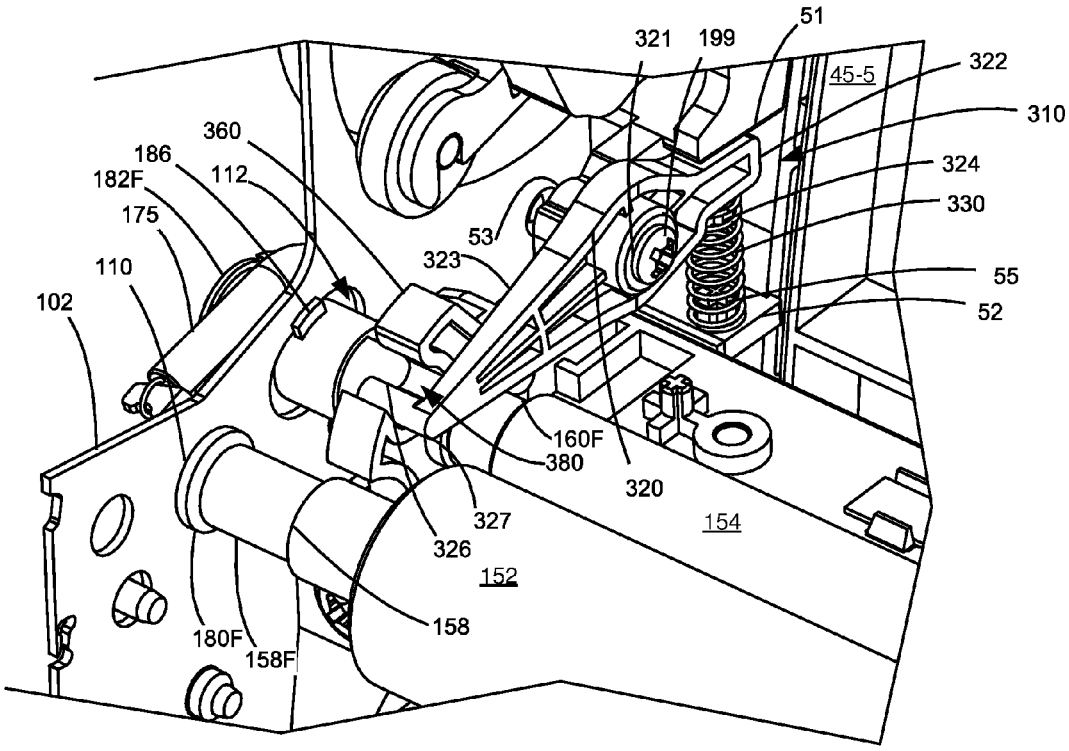
FIGS. 7-8 are enlarged partial perspective views of the front and back separator mechanisms of the present disclosure mounted on the feed roll assembly and to the interior of the side access door.
Figure 8:
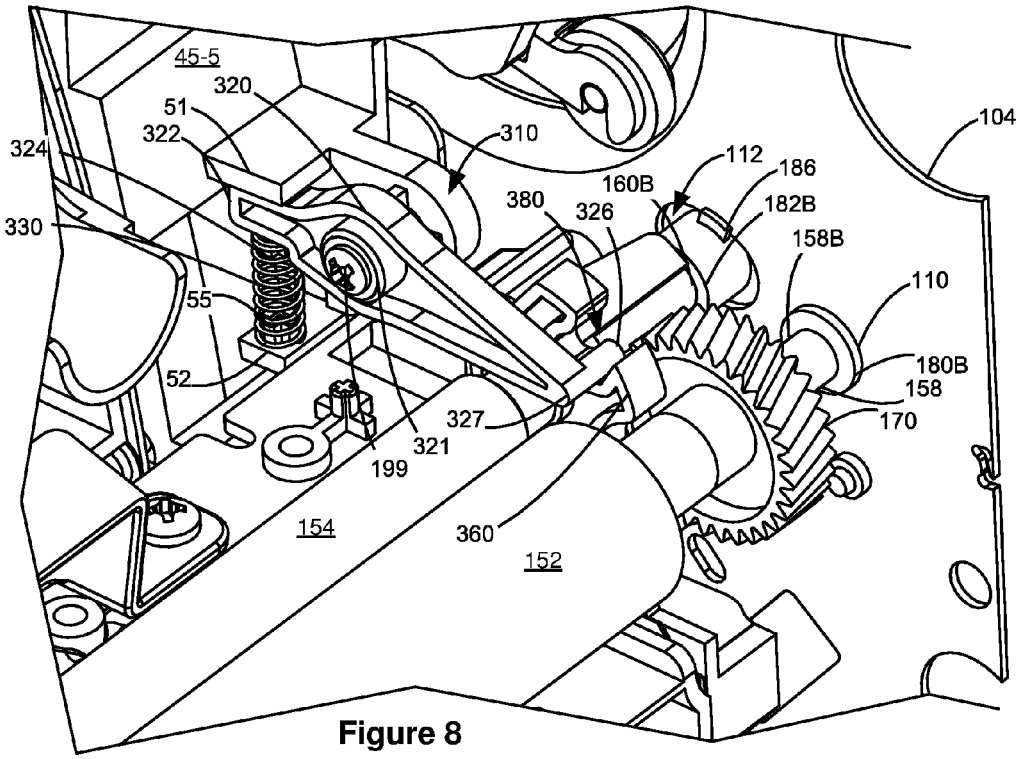

FIGS. 7 and 8 show actuator assembly 310 mounted on side access door 45 adjacent to the front and back ends 160F, 160B of shaft 160 of backup roll 154 while cam follower 360 is shown mounted on front and back ends 160F, 160B of shaft 160 of backup roll 154. FIG. 9 provides an exploded view of separator mechanism 300 shown at the front panel 102.

Actuator assembly 310 comprises an actuator arm 320 pivotally mounted to a mounting boss 53 provided between upper and lower stops 51, 52 on side access door 45. A pivot opening 321 sized to receive mounting boss 53 is provided approximately midway between the ends of actuator arm 320 dividing actuator arm into a first portion 322 and a second portion 323. A fastener 199 is used to pivotally attach actuator arm 320 to mounting boss 53 via opening 54 provided in mounting boss 53. Spring post 55 is provided on lower stop 52 and spring post 324 is provided on a bottom surface of first portion 322. Spring posts 55, 324 are illustrated as having a cruciform shape and are positioned opposite one another. A bias spring 330 is mounted between lower stop 52 and second portion 323 of actuator arm 320 to spring posts 55, 324. A cam follower 326, shown as a cylindrical pin 326, is provided at the free end 327 of second portion 323. When side access door 45 is closed, pin 326 rests in an engagement slot 380 provided in cam follower 360.

Figure 11:
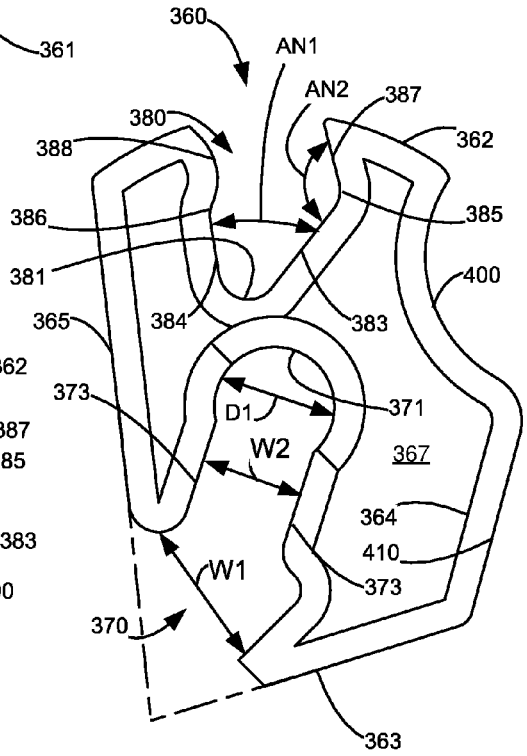
Figure 12:
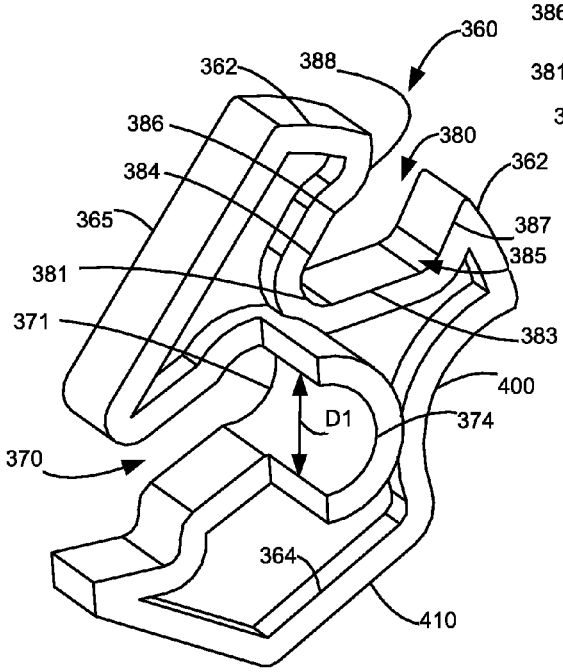

Referring to FIGS. 10-14, features of cam follower 360 will be described. Cam follower 360 comprises a plate or planar structure 361 having a mounting slot 370 and an engagement slot 380. Plate 361 has an irregular rectangular outline with a top 362, a bottom 363, a first side surface 364, a second side surface 365, an inner surface 366 and an outer surface 367. Plate 361 made be made of a compliant or resilient material such as, for non-limiting example, polyoxymethylene (POM). The inner surface 366 faces away from the adjacent side panel while the outer surface 367 faces toward the adjacent side panel. Mounting slot 370 extends from the center of plate 361 and angles toward the bottom 363 and second side surface 365. Mounting slot 370 has a closed circular end 371, an open end 372, and opposed walls 373 positioned approximately in the center of the plate 361 and is sized to rotatably receive the shaft 160 of backup roll 154. Mounting slot 370 has open end 372 extending through the second side surface 365 and the bottom 363. As seen in FIG. 11, the diameter D1 of closed end 371 is substantially equal to 2R2 (2×radius R2 of shaft 160). The width W1 of the open end 372 is slightly greater than the diameter of shaft 160 of backup roll 154. The width W2 between opposed walls 373 is less than diameter D1. Cam follower 360 can be snap mounted onto shaft 160 with shaft 160 separating the opposed walls 373 of mounting slot 370 as it moves through mounting slot 370 and enters into closed end 371 at which point opposed walls 373 return to their original position. A semi-cylindrical collar 374, also having diameter D1, may be provided as shown in FIG. 12. Collar 374 extends from outer surface 367 of plate 361 increasing the bearing surface of plate 361 on shaft 160 of backup roll 154 and increasing resistance to twisting of cam follower 360 during operation.

Engagement slot 380 has a closed end 381 and an open end 382. Closed end 381 is positioned adjacent to closed end 371 of mounting slot 370. Open end 382 extends through the top 362 of plate 361. Engagement slot 380 has a first wall 383 and a second wall 384 angled to form a generally V-shaped opening. As shown in FIG. 11, first and second walls 383, 384 form an acute angle A1. First and second wall 383, 384, have a first catch or engagement point 385 and a second catch or engagement point 386, respectively, positioned inward from open end 382 of engagement slot 380. A distal end portion 387 of first wall 383 is planar and angled inwardly into engagement slot 380 to form first catch point 385 along first wall 383. End portion 387 forms an obtuse angle AN2 with respect to first wall 383. A distal end portion 388 of second wall has a concave or slightly rounded shape extending inwardly into engagement slot 380 to form second catch point 386 along second wall 384. First and second catch points 385, 386, are respectively located approximately the same distance from open end 382 or from closed end 381 of engagement slot 380.

Figure 13:
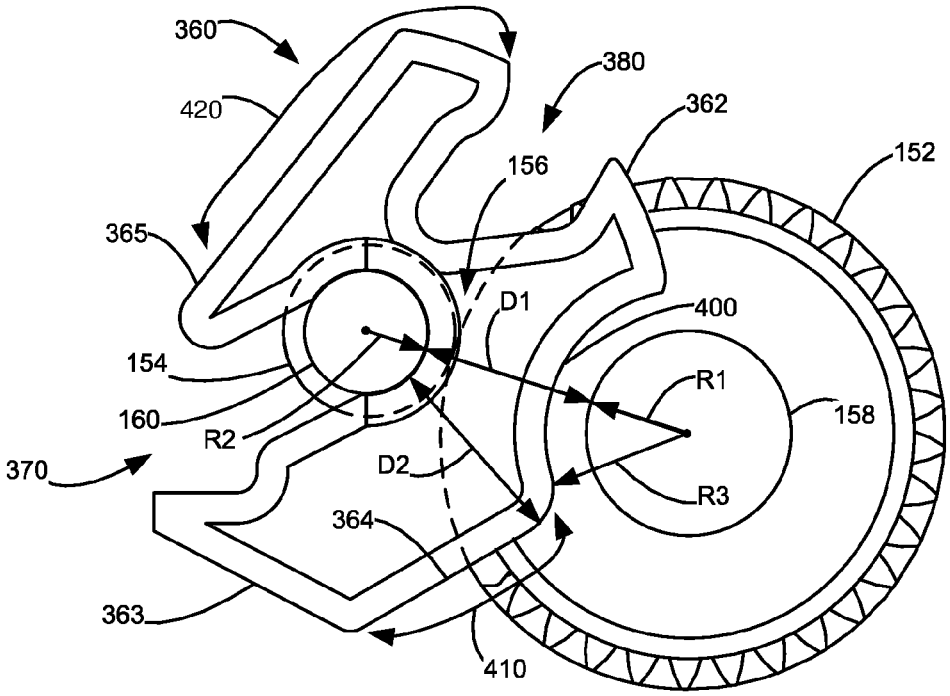
FIG. 13 illustrates the cam follower of the separator mechanism of the present disclosure in a disengaged position where the feed nip is closed.
Figure 14:
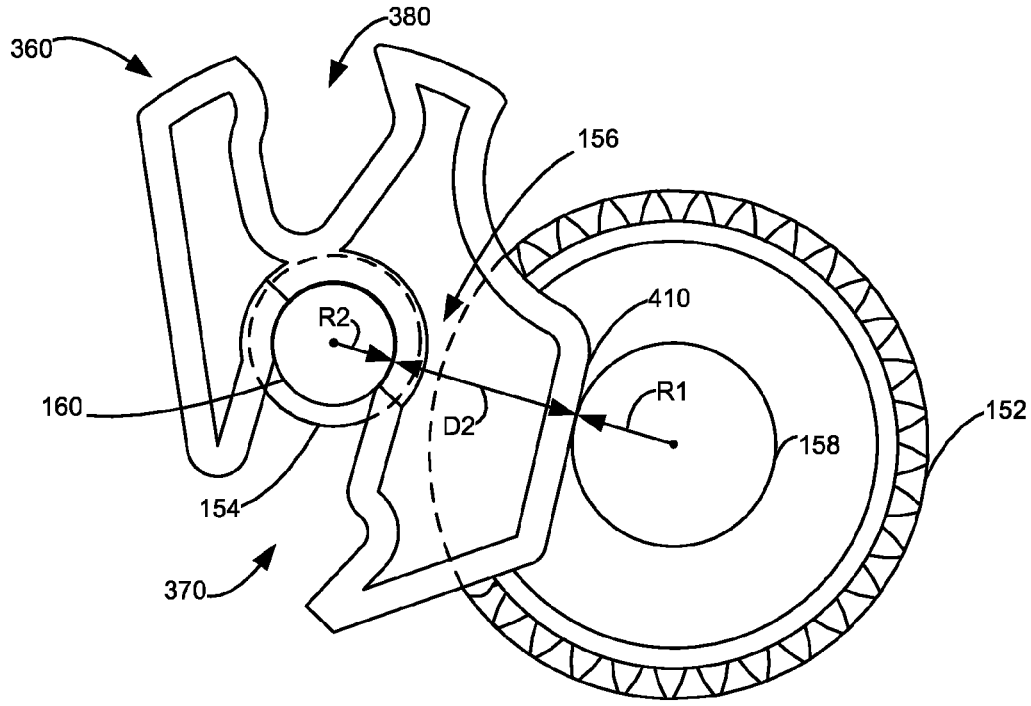
FIG. 14 illustrates the cam follower of the separator mechanism of the present disclosure in an engaged position opening the feed nip.

First side surface 364 of cam follower 360 is comprised of an upper convex or inwardly curved portion 400 and a lower planar portion 410 that is angled inward from where it joins curved portion 400 to where it joins the bottom 363. Lower planar portion 410 forms a first camming surface 410. As shown in FIG. 13, first camming surface 410 is positioned at a radial distance D2 as measured from either the surface of the shaft 160 of backup roll 154 or from the edge of closed end 371 of mounting slot 370 to first side 364 of cam follower 360. Distance D2 is greater than a radial distance D1 measured from the edge of either the surface of the shaft 160 of backup roll 154 or from closed end 371 of mounting slot 370 to the surface of shaft 158 of drive roll 152 when the backup roll 154 and drive roll 152 are in contact and the feed nip 156 is closed as shown in FIG. 13. When cam follower 360 is in an engaged position as shown in FIG. 14, the magnitude of distance D2 is such that backup roll 154 is translated away from drive roll 152 opening feed nip 156. Stated in another manner, the radius R2 of shaft 160 plus distance D1 is less than radius R2 plus distance D2 (i.e., R2+D1<R2+D2). Also, the radius of curvature R3 of curved portion 400 as measured from the center of shaft 158 of drive roll 152 is greater than radius R1 of shaft 158 so that, when cam follower 360 is in a disengaged position as shown in FIG. 13, cam follower 360 does not contact shaft 158. A portion of the top 362 adjacent to the second side surface 365 and a portion of second side surface 365 form an inverted L-shaped second camming surface 420 which is engaged at times by pin 326 on actuator arm 320 during opening and closing of side access door 45.

By way of example and not limitation, in one embodiment, R1 is about 5.0 mm, R2 is about 3.0 mm, D1 is about 8.5 mm, D2 is about 9.5 mm, width W2 is about 5.2 mm, radius R3 may be in the range of about 7.0 mm to about 9.0 mm, angle AN1 may be in the range of about 45 degrees to about 50 degrees, and angle AN2 may be in the range of about 120 degrees to about 130 degrees.

In FIGS. 15A-15G, normal operation of separator mechanism 300 will be described while in FIGS. 16A-16F, operation of separator mechanism 300 when one of the cam followers 360 in separator mechanism 300 is accidentally disengaged by a user prior to the closing of side access door 45 is shown. Because both separator mechanisms operate in the same manner, only a single separator mechanism 300 is shown in FIGS. 15A-16F.

Figure 15A:
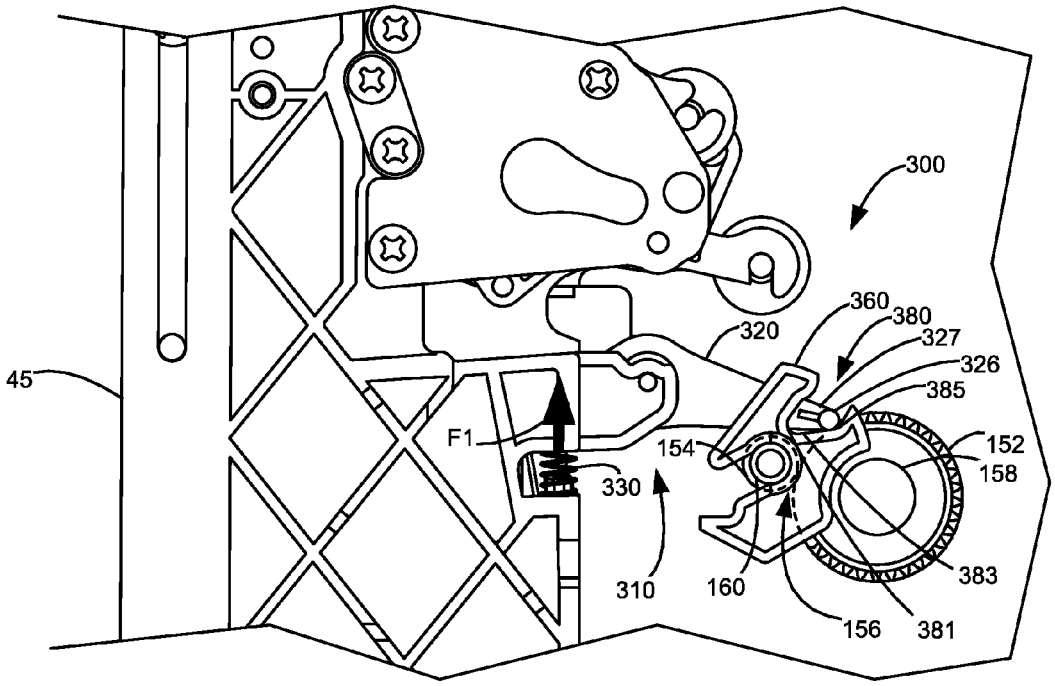
FIGS. 15A-15G depict a normal opening and closing sequence of the door and operation of the separator mechanism where

In FIG. 15A, side access door 45 is in the closed position and separator mechanism 300 is shown in a disengaged position. Actuator assembly 310 is mounted on the interior of side access door 45. Cam follower 360 is disengaged from shaft 158 of drive roll 152. Pin 326 of actuator arm 320 is shown abutting first catch point 385 on first wall 383 of engagement slot 380 after having rotated cam follower 360 in a clockwise direction as viewed in FIG. 15A. Bias spring 330 applies an upwardly directed force F1 to actuator arm 320, pivoting the free end 327 of actuator arm 320 in a downward direction toward the closed end 381 of engagement slot 380. Feed nip 156 is closed and the radial distance between the centers of shaft 158 of drive roll 152 and shaft 160 of backup roll 154 is R1+D1+R2 as previously described.

Figure 15B:
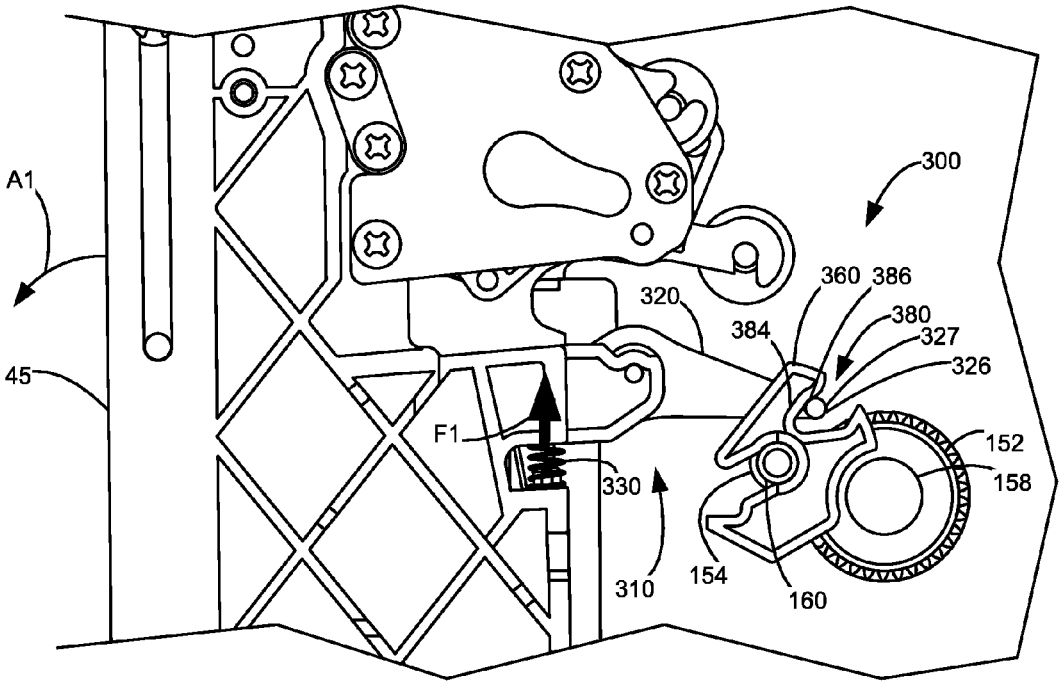

In FIG. 15B, side access door 45 has begun to rotate open (as indicated by arrow A1) and separator mechanism 300 is still in a disengaged position. Pin 326 of actuator arm 320 has moved and is now shown abutting second catch point 386 on second wall 384 of engagement slot 380. Bias spring 330 continues to apply the biasing force F1 to actuator arm 320. Feed nip 156 is still closed and the radial distance between the centers of shaft 158 of drive roll 152 and shaft 160 of backup roll 154 remains R1+D1+R2 as previously described.

Figure 15C:
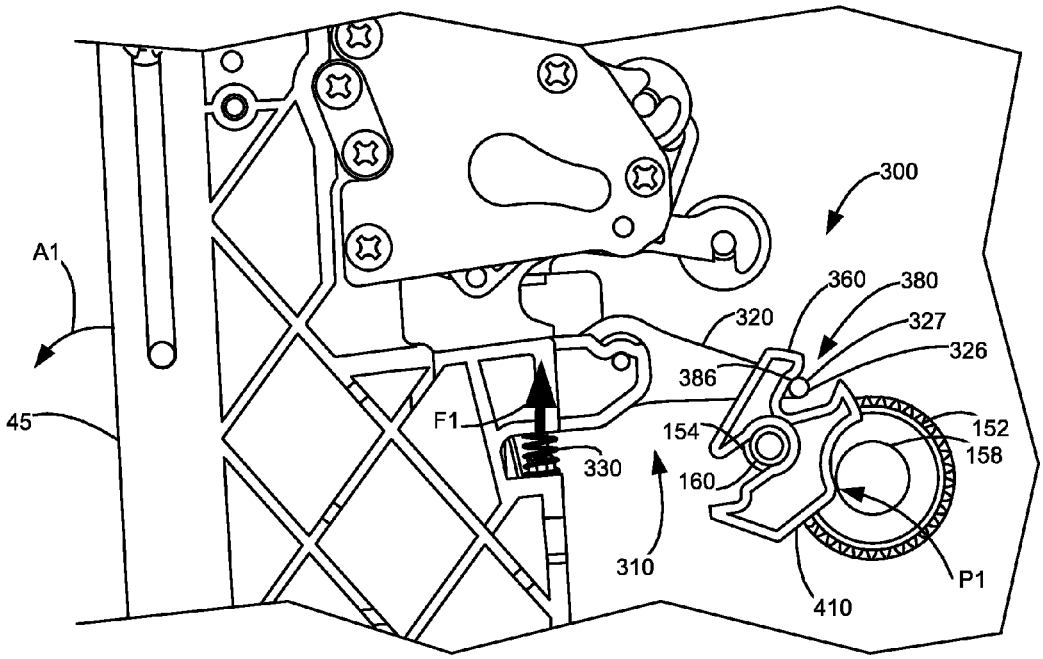

In FIG. 15C, side access door 45 has rotated further open and separator mechanism 300 has rotated further with first camming surface 410 coming into initial contact at point P1 with shaft 158 of drive roll 152. Pin 326 of actuator arm 320 remains in second catch point 386 of engagement slot 380. Backup roll 154 has not yet begun to translate (toward the left side of the figure as viewed) and feed nip 156 is still closed and the radial distance between the centers of shaft 158 of drive roll 152 and shaft 160 of backup roll 154 remains R1+D1+R2 as previously described.

Figure 15D:
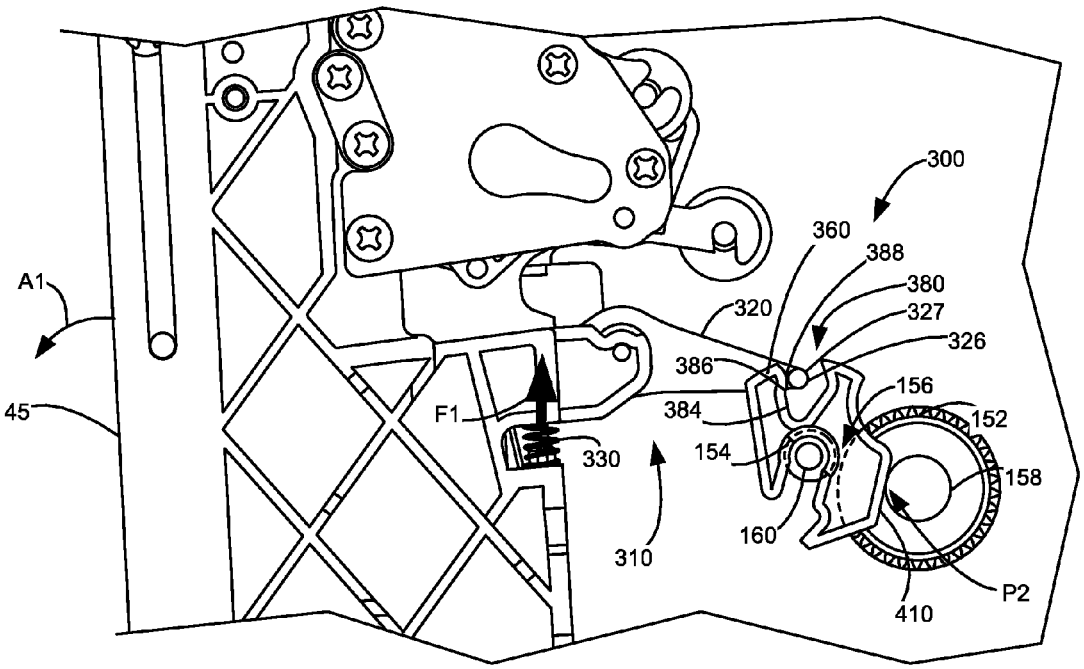

In FIG. 15D, side access door 45 has rotated still further open and cam follower 360 of separator mechanism 300 has rotated farther counter clockwise with first camming surface 410 coming into a fully engaged position at P2 with shaft 158 of drive roll 152. Pin 326 of actuator arm 320 has moved out and upward from second catch point 386 in engagement slot 380 and is shown on the distal end portion 388 of second wall 384. Backup roll 154 has translated (toward the left side of the figure as viewed) and feed nip 156 has opened and the radial distance between the centers of shaft 158 of drive roll 152 and shaft 160 of backup roll 154 is now R1+D2+R2 as previously described.

Figure 15E:
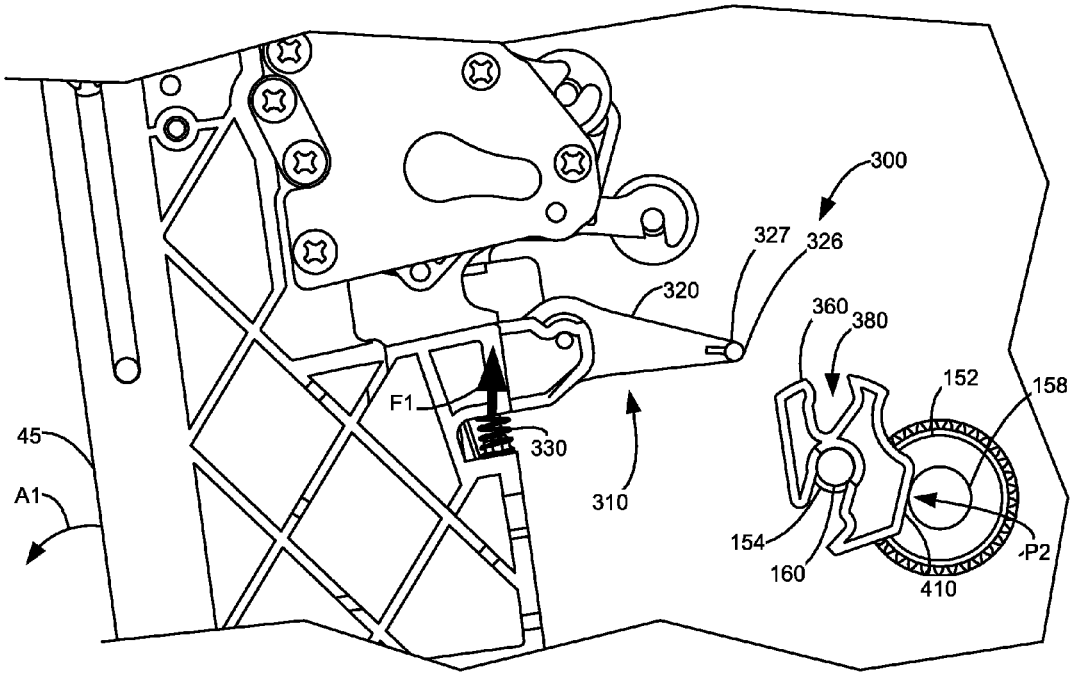

In FIG. 15E, side access door 45 has rotated still further open and actuator arm 320 of actuator assembly 310 has separated from cam follower 360. The inwardly rounded shape of distal end portion 388 of second wall 384 also allows for a smooth release of pin 326 from engagement slot 380. Pin 326 of actuator arm 320 has moved out and upward from second catch point 386 in engagement slot 380 and is shown on the distal end portion 388 of second wall 384. First camming surface 410 remains in the engaged position at P2 with shaft 158 of drive roll 152. Backup roll 154 has translated (toward the left side of the figure as viewed), feed nip 156 remains open, and the radial distance between the centers of shaft 158 of drive roll 152 and shaft 160 of backup roll 154 is still R1+D2+R2 as previously described.

Figure 15F:
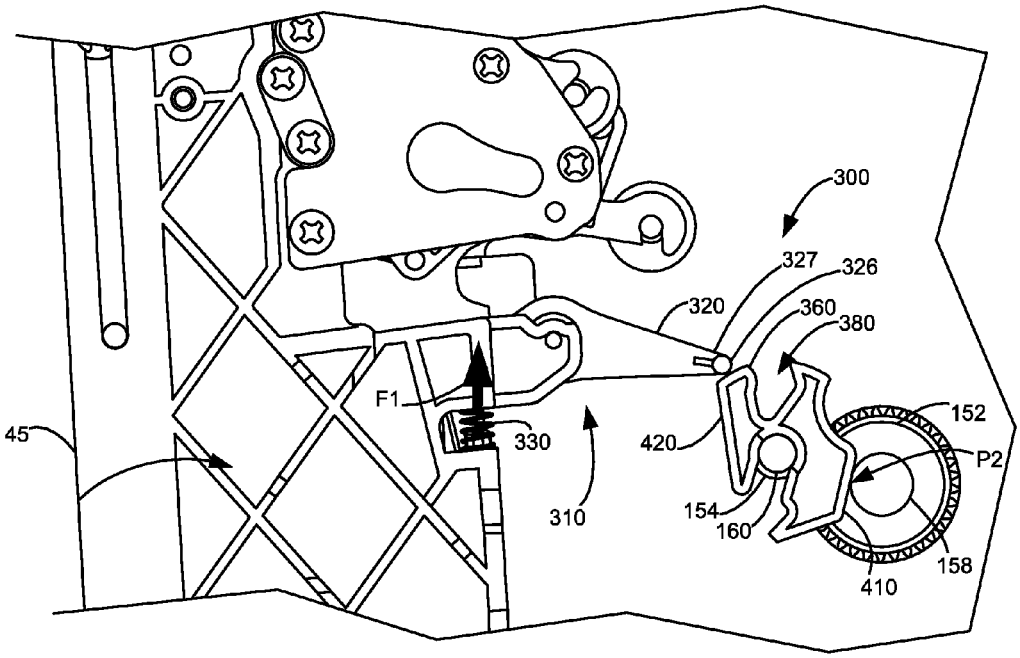

In FIG. 15F, side access door 45 is shown rotating toward its closed position and actuator arm 320 has come into contact with second camming surface 420. As side access door 45 continues to close, pin 326 on actuator arm 320 will travel along second camming surface 420 until it re-enters engagement slot 380. First camming surface 410 remains in the engaged position at P2 with shaft 158 of drive roll 152. Backup roll 154 is still at its translated position, feed nip 156 remains open, and the spacing or radial distance between the centers of shaft 158 of drive roll 152 and shaft 160 of backup roll 154 is still R1+D2+R2 as previously described.

Figure 15G:
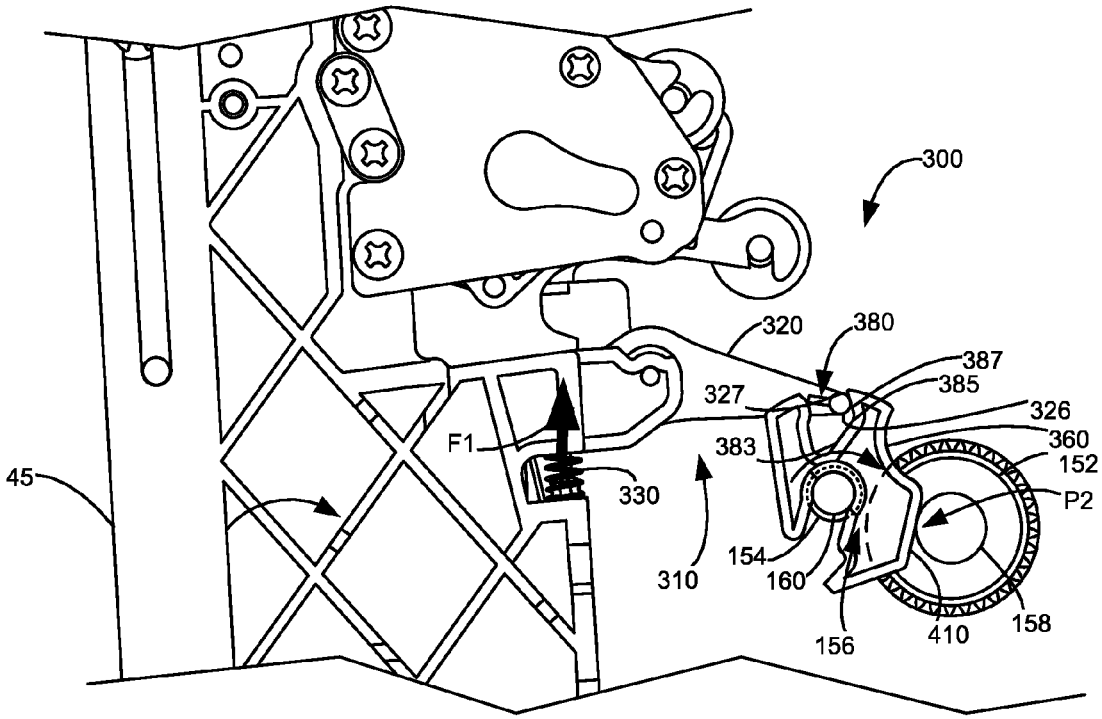

In FIG. 15G, side access door 45 has rotated further closed and cam follower 326 has re-entered engagement slot 380 due to the biasing force F1 supplied by bias spring 330. Pin (or cam follower) 326 has engaged the distal portion 387 of first wall 383 and is moving toward first catch point 385. First camming surface 410 remains in the engaged position at point P2 with shaft 158 of drive roll 152. Backup roll 154 is still at its translated position, feed nip 156 remains open, and the radial distance between the centers of shaft 158 of drive roll 152 and shaft 160 of backup roll 154 is still R1+D2+R2 as previously described. As side access door 45 continues to close, pin 326 reaches first catch point 385 and rotates cam follower 360 clockwise as view in FIG. 15G, returning cam follower 360 to the disengaged position shown in FIG. 15A allowing backup roll 154 to translate back toward drive roll 152 closing feed nip 156. As side access door 45 is cycled open and closed, the action of separator mechanism 300 described in FIGS. 15A-15G will be repeated. While two separator mechanisms 300 are shown mounted on the respective ends of backup roll 154 and front and back edges of side access door 45, a single separator mechanism mounted on one of respective shaft ends and door edges may be used to open feed nip 156.

Figure 16A:
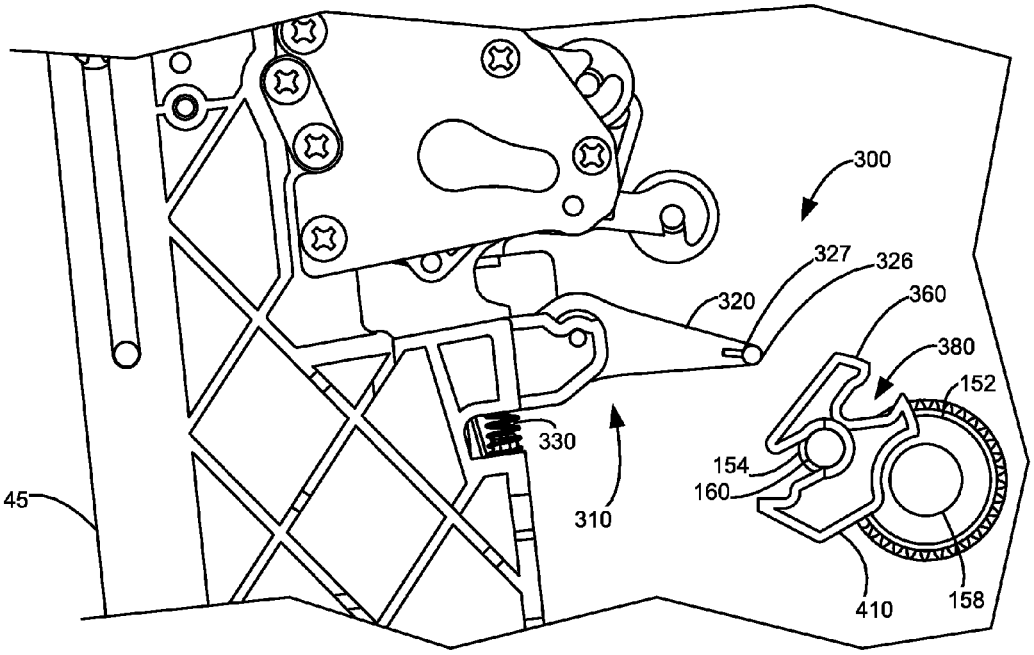
FIGS. 16A-16F show a closing sequence of the access door where

Referring now to FIGS. 16A-16F, closing operation of separator mechanism 300 will be described when side access door 45 is open and cam follower 360 has accidentally been moved to its disengaged position allowing the backup roll 154 to translate back into contact with driver roll 152. First camming surface 410 is disengaged from shaft 158. FIG. 16A depicts this position.

Figure 16B:
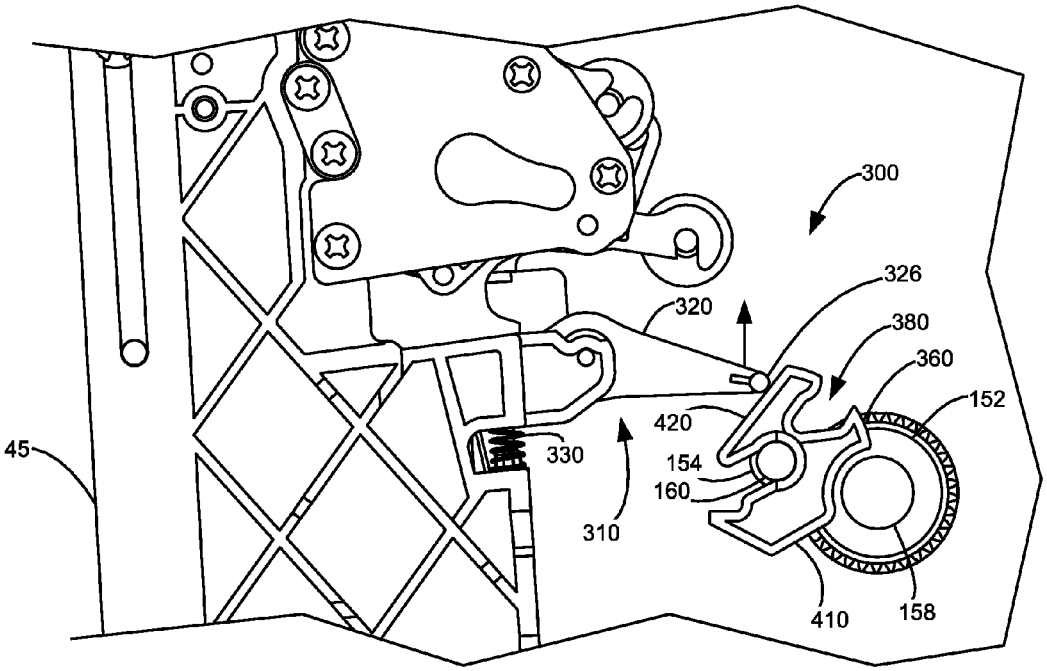
Figure 16C:
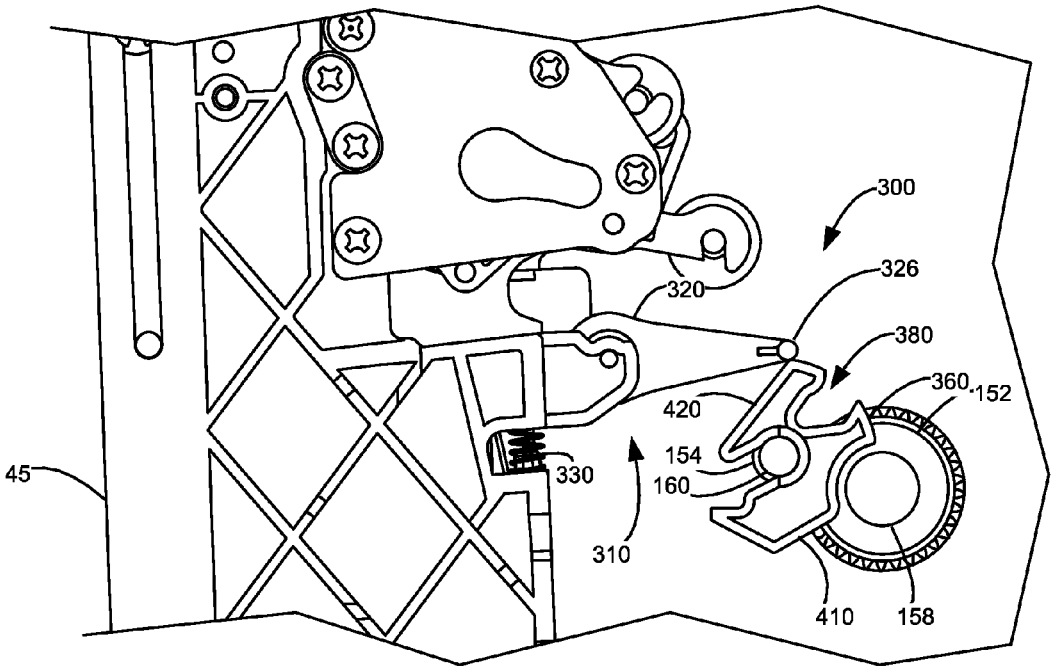
Figure 16D:
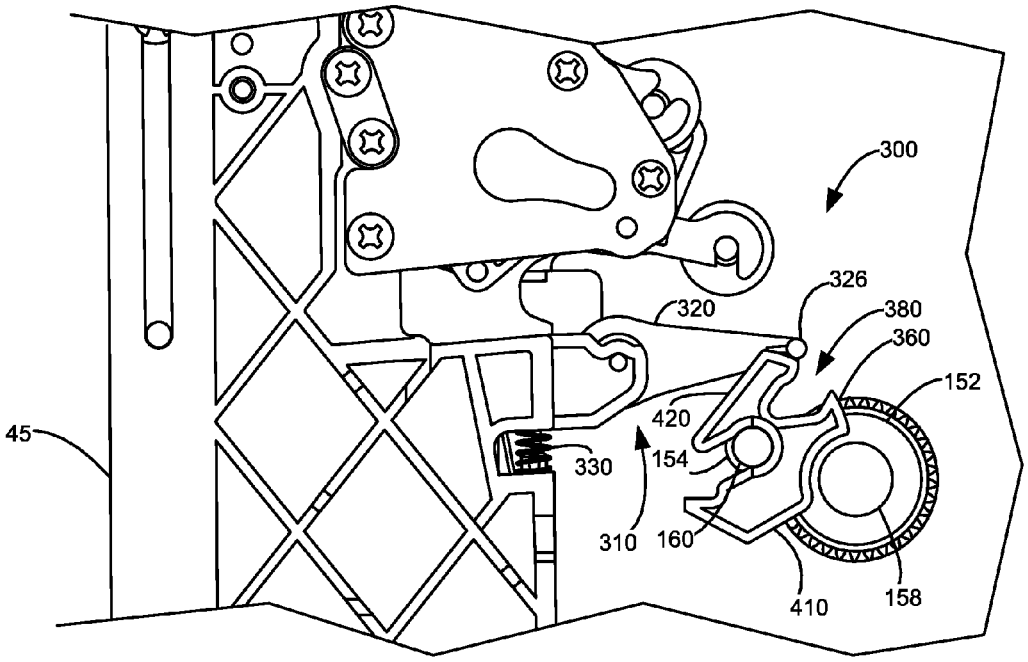
Figure 16E:
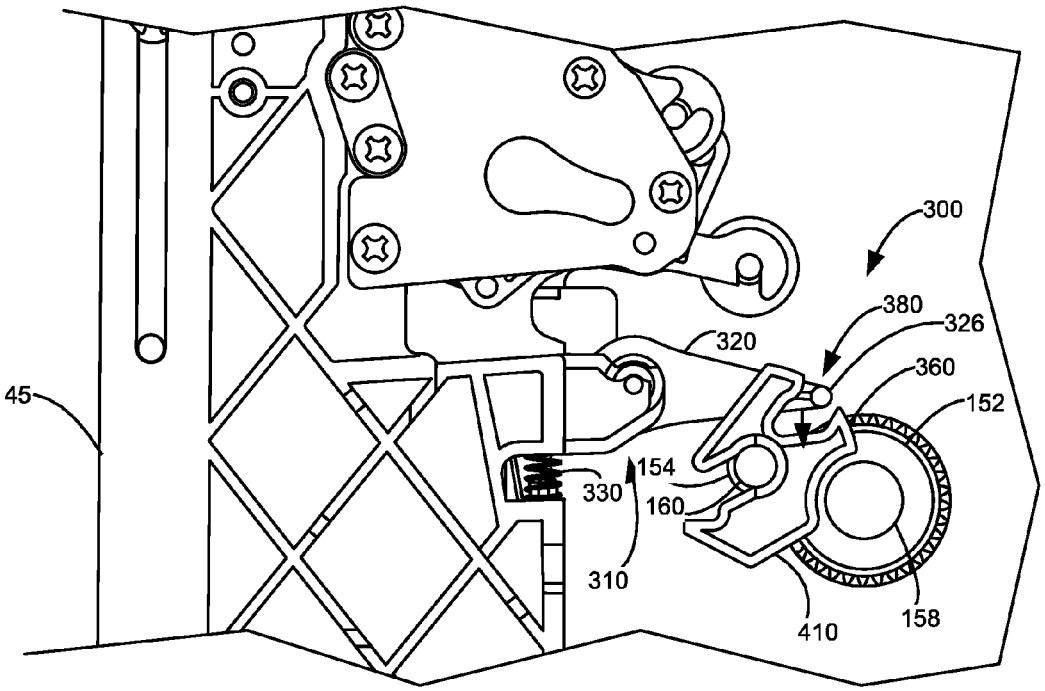
Figure 16F:
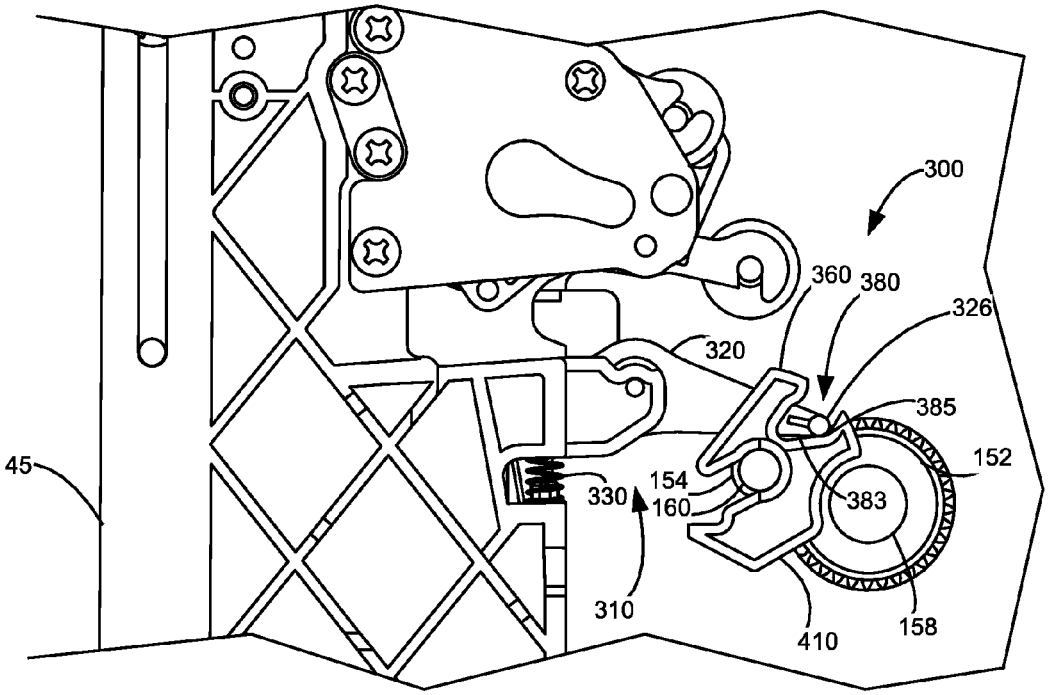

In FIG. 16B, side access door 45 continues closing. Cam follower or pin 326 of actuator arm 320 engages with second camming surface 420 on cam follower 360 which when in the disengaged position angles second camming surface 420 so that pin 326 will move upwardly. As side access door 45 continues to close, pin 326 rides along second camming surface 420 approaching engagement slot 380 as shown in FIGS. 16C-16D. In FIG. 16E, as closing of side access door 45—continues, pin 326 has entered engagement slot 380 due to the force supplied by bias spring 330 in rotating actuator arm 320 downward or clockwise. In FIG. 16F, side access door 45 has reached its closed position and pin 326 is once again abutting first catch point 385 on first wall 383 of engagement slot 380. When side access door 45 is reopened, separator mechanism 300 will operate as previously described.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. An imaging device comprising:

a frame having a pair of opposed panels spaced apart and having a media path therebetween;

a door pivotally mounted along a bottom edge thereof to the frame, the door having a raised closed position and a lowered open position, the door substantially covering the media path between the pair of opposed panels when in the closed position;

a feed roll pair mounted across the media path and between the pair of opposed panels, the feed roll pair having a drive roll and a backup roll forming a feed nip for a media sheet therebetween, the drive roll having a shaft having a radius R1, the backup roll having a shaft having a radius R2 wherein when the door is in the closed position a distance between respective surfaces of the shafts of the backup roll and the drive roll is a predetermined distance D1, the drive roll being rotatably mounted to the pair of opposed panels, and, the backup roll being translateably mounted to the pair of opposed panels and spring-biased into contact with the drive roll;

and, a separator mechanism for separating the backup roll from the drive roll, the separator mechanism including:

a spring-biased first actuator arm pivotally mounted on an inner surface of the door and extending therefrom toward the feed roll pair, the first actuator arm having a free end with a cylindrical pin depending therefrom; and, a first cam follower rotatably mounted on the shaft of the backup roll, the first cam follower comprising a plate having:

a top, a bottom, a first side surface and a second side surface;

a mounting slot having a closed circular end positioned approximately in the center of the plate and sized to rotatably receive the shaft of the backup roll, the mounting slot having an open end extending through the second side surface and the bottom;

an engagement slot having a first wall and a second wall angled to form a generally V-shaped opening with an open end positioned in the top of the plate, the first and second walls having a first and a second catch point, respectively;

the first side surface having a first camming surface along a portion thereof, the first camming surface positioned at a distance D2 from the surface of the shaft of the backup roll that is greater than the distance D1; and, the second side surface and a portion of the top adjacent to the second side surface forming an inverted L-shaped second camming surface, wherein, when the door is in the closed position, the pin is biased into the engagement slot and the first cam follower is in a disengaged position with respect to the shaft of the drive roll and a spacing between respective centers of the shafts of the backup roll and the drive roll is substantially equal to R1+R2+D1, and, as the door is opened, the pin engages with the second catch point rotating the first cam follower in a first direction so that the first camming surface contacts the shaft of the drive roll translating the backup roll away from the drive roll to open the feed nip and placing the first cam follower in an engaged position with the shaft of the drive roll with the spacing between respective centers of the shafts of the backup roll and the drive roll being substantially equal to R1+R2+D2.

2. The imaging device of claim 1, wherein, as the door continues to open, the pin disengages from the second catch point and exits the engagement slot with the first actuator arm disengaging from the first cam follower.

3. The imaging device of claim 1, wherein, when the door is moved back from the open position to the closed position, the pin is biased into contact with the second camming surface and rides thereon and reenters the engagement slot and reengages with the first catch point, and, as the door continues closing, the first actuator arm rotates the first cam follower in a second direction opposite to the first direction to disengage the first camming surface from the shaft of the drive roll returning the first cam follower to its disengaged position and allowing the backup roll to translate back toward the drive roll closing the feed nip.

4. The imaging device of claim 1, wherein, the door has an upper stop and a lower stop mounted adjacent to one of a front edge and a back edge of the door on the inner surface thereof, and the separator mechanism further comprises:

the first actuator arm being pivotally mounted between the upper and the lower stops, the first actuator arm extending toward an end of the backup roll and having a first end; and, a first biasing spring positioned between the first end of the first actuator arm and the lower stop, the first biasing spring biasing the first end against the upper stop moving the free end of the first actuator arm in a downward direction.

5. The imaging device of claim 1, wherein, the first spring-biased actuator arm is mounted on the door at a position adjacent to one end of the backup roll and the first cam follower is rotatably mounted to the one end of the shaft of the backup roll.

6. The imaging device of claim 5, wherein, the separator mechanism includes a spring-biased second actuator arm and a second cam follower engageable with the second actuator arm with the second actuator arm being mounted on the door adjacent to an other end of the backup roll and the second cam follower being rotatably mounted on an other end of the shaft of the backup roll.

7. The imaging device of claim 6 wherein, the mounting slot of each of the first and second cam followers has sides spaced apart a width that is less than a diameter of the shaft of the backup roll allowing the first and second cam followers to be snap mounted onto the shaft of the backup roll.

8. The imaging device of claim 1, wherein, the first cam follower mounting slot has sides spaced apart a width that is less than a diameter of the shaft of the backup roll allowing the first cam follower to be snap mounted onto the shaft of the backup roll.

9. An imaging device comprising:

a frame having a pair of opposed panels spaced apart and having a media path therebetween;

a door pivotally mounted along a bottom edge thereof to the frame, the door having a raised closed position and a lowered open position, the door substantially covering the media path between the pair of opposed panels when in the closed position;

a feed roll pair mounted across the media path and between the pair of opposed panels, the feed roll pair having a drive roll and a backup roll forming a feed nip therebetween, the drive roll having a shaft having a radius R1, the backup roll having a shaft having a radius R2 wherein when the door is in the closed position a distance between respective surfaces of the shafts of the backup roll and the drive roll is a predetermined distance D1, the drive roll being rotatably mounted to the pair of opposed panels, and, the backup roll being translateably mounted to the pair of opposed panels and spring-biased into contact with the drive roll;

and, a separator mechanism for separating the backup roll from the drive roll, the separator mechanism including:

a spring-biased first actuator arm pivotally mounted on an inner surface of the door and extending therefrom toward the feed roll pair, the first actuator arm having a free end with a cylindrical pin depending transversely therefrom; and, a first cam follower rotatably mounted on the shaft of the backup roll, the first cam follower comprising a compliant plate having:

a top, a bottom, a first side surface and a second side surface;

a mounting slot having a circular end having a radius equal to or greater than R2 and positioned approximately in the center of the plate and sized to rotatably receive the shaft of the backup roll, the mounting slot having an open end extending through the second side surface and the bottom with a width of the open end being less than 2R2;

an engagement slot having a first wall and a second wall angled to form a generally V-shaped opening with an open end positioned in the top of the plate, the first and second walls having a first and a second catch point, respectively;

the first side surface having an upper concave portion and a lower planar portion forming a first camming surface, the first camming surface positioned at a distance D2 from the surface of the shaft of the backup roll that is greater than the distance D1; and, the second side surface and a portion of the top adjacent to the second side surface forming an inverted L-shaped second camming surface, wherein, when the door is in the closed position, the pin is biased into the engagement slot and the first cam follower is in a disengaged position with respect to the shaft of the drive roll and the feed nip is closed with a spacing between respective centers of the shafts of the backup roll and the drive roll being substantially equal to R1+R2+D1, and, as the door is opened, the pin engages with the second catch point rotating the first cam follower in a first direction so that the first camming surface contacts the shaft of the drive roll translating the backup roll away from the drive roll to open the feed nip and placing the first cam follower in an engaged position with the shaft of the drive roll with the spacing between respective centers of the shafts of the backup roll and the drive roll being substantially equal to R1+R2+D2, and, as the door continues to open, the pin disengages from the second catch point and exits the engagement slot disengaging the first actuator arm from the first cam follower.

10. The imaging device of claim 9, wherein, when the door is moved back from the open position to the closed position, the pin is biased into contact with the second camming surface and rides thereon and reenters the engagement slot and engages with the first catch point, and, as the door continues closing, the first actuator arm rotates the first cam follower in a second direction opposite to the first direction to disengage the first camming surface from the shaft of the drive roll returning the first cam follower to its disengaged position and allowing the backup roll to translate back toward the drive roll closing the feed nip.

11. The imaging device of claim 9, wherein, the door has an upper stop and a lower stop mounted adjacent to one of a front edge and a back edge of the door on the inner surface thereof and the separator mechanism further comprises:

the first actuator arm being pivotally mounted between the upper and the lower stop, the first actuator arm extending toward an end of the backup roll and having a first end; and, a first biasing spring positioned between the first end of the first actuator arm and the lower stop, the first biasing spring biasing the first end against the upper stop moving the free end of the first actuator arm in a downward direction.

12. The imaging device of claim 9, wherein, the first spring-biased actuator arm is mounted on the door at a position adjacent to one end of the backup roll and the first cam follower is rotatably mounted to the one end of the shaft of the backup roll.

13. The imaging device of claim 9, wherein, the separator mechanism includes a spring-biased second actuator arm and a second cam follower engageable with the second actuator arm with the second actuator arm being mounted on the door adjacent to an other end of the backup roll and the second cam follower being rotatably mounted on an other end of the shaft of the backup roll.

14. The imaging device of claim 13, wherein, the mounting slot of each of the first and second cam followers has sides spaced apart a width that is less than the diameter of the shaft of the backup roll allowing the first and second cam followers to be snap mounted onto the shaft of the backup roll.

15. The imaging device of claim 9, wherein, the first cam follower mounting slot has sides spaced apart a width that is less than a diameter of the shaft of the backup roll allowing the first cam follower to be snap mounted onto the shaft of the backup roll.

16. An imaging device comprising:

a frame having a pair of opposed panels spaced apart and having a media path therebetween;

a door pivotally mounted along a bottom edge thereof to the frame, the door having a raised closed position and a lowered open position, the door substantially covering the media path between the pair of opposed panels when in the closed position;

a feed roll pair mounted across the media path and between the pair of opposed panels, the feed roll pair having a drive roll and a backup roll forming a feed nip therebetween, the drive roll having a shaft having a radius R1, the backup roll having a shaft having a radius R2 wherein when the door is in the closed position a distance between respective surfaces of the shafts of the backup roll and the drive roll is a predetermined distance D1, the drive roll being rotatably mounted to the pair of opposed panels, and, the backup roll having a pair of bushings mounted on respective ends of the shaft of the backup roll with each bushing of the pair of bushings being translateably mounted to a respective one of the pair of opposed panels, and a pair of springs each spring of the pair of springs wrapped around a respective one of the pair of bushings and having ends fastened to a respective one of the pair of opposed panels, the pair of springs applying a force to the backup roll to bias the backup roll into contact with the drive roll;

and, a separator mechanism for separating the backup roll from the drive roll, the separator mechanism including:

a pair of upper stops and a pair of lower stops one of each of the upper and lower stops of the pairs of upper and lower stops mounted adjacent a front edge and the other of each of the upper and lower stops of the pairs of upper and lower stops mounted adjacent a back edge of the door on an inner surface thereof;

a first and a second actuator arm respectively pivotally mounted adjacent the front and the back edge of the door on the inner surface thereof between the respective upper and lower stops of the pairs of upper and lower stops, the first and second actuator arms extending toward respective ends of the backup roll, each actuator arm having a first end and a second end with the second end having a cylindrical pin depending transversely therefrom;

a pair of biasing springs positioned between the respective first ends of the first and second actuator arms and a respective one of the pair of lower stops, the pair of biasing springs biasing the respective first ends of the first and second actuator arms against the respective one of the pair of upper stops moving the respective second ends of the first and second actuator arms in a downward direction;

and, a pair of cam followers with each cam follower rotatably mounted on the respective end of the shaft of the backup roll, each cam follower comprising a compliant plate having:

a top, a bottom, a first side surface and a second side surface;

a downwardly angled mounting slot having a closed circular end having a radius equal to or greater than R2 and positioned approximately in the center of the plate and sized to rotatably receive the shaft of the backup roll, the mounting slot having an open end extending through the second side surface and the bottom with a width W of the mounting slot being less than 2R2;

an upwardly oriented engagement slot having a first wall and a second wall acutely angled to form a generally V-shaped opening with an open end positioned in the top of the plate, the first and second walls having a first and a second catch point, respectively;

the first side surface having an upper concave portion having a radius of curvature R3 with respect to a center of the shaft of the drive roll that is greater than R1 and a lower planar portion forming a first camming surface, the first camming surface positioned at a distance D2 from the surface of the shaft of the backup roll that is greater than the distance D1; and, the second side surface and a portion of the top adjacent to the second side surface forming an inverted L-shaped second camming surface, wherein, when the door is in the closed position, the pins are biased into their respective engagement slots and the pair of cam followers are in a disengaged position with respect to the shaft of the drive roll, the upper concave portion of the first side surface is adjacent to but spaced apart from the shaft of the drive roll and the feed nip is closed with a spacing between the respective centers of the shafts of the backup roll and the drive roll being substantially equal to R1+R2+D1, and, as the door is opened, the pins engage with their respective second catch points rotating the pair of cam followers in a first direction so that the respective first camming surfaces contact the respective ends of the shaft of the drive roll translating the backup roll away from the drive roll to open the feed nip and placing the pair of cam followers in respective engaged positions with the shaft of the drive roll where the spacing between respective centers of the shafts of the backup roll and the drive roll substantially equals R1+R2+D2, and, as the door continues to open the pins disengage from their respective second catch points and exit their respective engagement slots disengaging each of the first and second actuator arms from their respective one of the pair of cam followers.

17. The imaging device of claim 16, wherein, when the door is moved back from the open position to the closed position, the pins are biased into contact with their respective second camming surface and ride thereon and reenter their respective engagement slots and engage with the respective first catch points, and, as the door continues closing, the pair of cam followers are rotated in a second direction opposite to the first direction to disengage the respective first camming surfaces from the shaft of the drive roll allowing the backup roll to translate back toward the drive roll closing the feed nip.

18. The imaging device of claim 16, wherein, the mounting slot of each cam follower has sides spaced apart a width that is less than the diameter of the shaft of the backup roll allowing the pair of cam followers to be snap mounted onto the shaft of the backup roll.

19. The imaging device of claim 16, wherein, R1 is about 5.0 mm, R2 is about 3.0 mm, D1 is about 8.5 mm, D2 is about 9.5 mm, the width W is about 5.2 mm, and R3 is in the range of about 7.0 mm to about 9.0 mm.

20. The imaging device of claim 16 further comprising:

a controller;

a drive motor in operative communication with the controller;

a door interlock sensor in operative communication with the controller, the door interlock sensor being actuated when the door is in the closed position and deactuated when the door is in the open position;

a gear train coupled to the drive motor; and, a drive gear mounted on the drive roll and coupled to the gear train, wherein, with the door in a closed position and the door interlock sensor actuated, the controller is operable to activate the drive motor to drive the drive roll for feeding a media sheet along the media path, and, with the door in the open position and the door interlock sensor deactuated, the controller deactivates the drive motor with the separator mechanism translating the backup roll away from the drive roll.

* * * * *